US009259731B2

(12) United States Patent
Momose et al.

(10) Patent No.: US 9,259,731 B2
(45) Date of Patent: Feb. 16, 2016

(54) LIQUID REAGENT CONTAINING MICROCHIP AND METHOD OF USING THE SAME, AND PACKAGED LIQUID REAGENT CONTAINING MICROCHIP

(71) Applicant: Rohm Co., Ltd., Kyoto (JP)

(72) Inventors: Shun Momose, Kyoto (JP); Hidetaka Okada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 83 days.

(21) Appl. No.: 13/744,596

(22) Filed: Jan. 18, 2013

(65) Prior Publication Data

US 2013/0196442 A1 Aug. 1, 2013

(30) Foreign Application Priority Data

Jan. 27, 2012 (JP) ..... 2012-015220

(51) Int. Cl.
*B01L 3/00* (2006.01)
*B65D 75/58* (2006.01)

(52) U.S. Cl.
CPC ..... *B01L 3/50273* (2013.01); *B01L 3/502723* (2013.01); *B01L 2200/141* (2013.01); *B01L 2200/16* (2013.01); *B01L 2300/041* (2013.01); *B01L 2300/0816* (2013.01); *B01L 2300/0864* (2013.01); *B01L 2300/0867* (2013.01); *B01L 2300/0887* (2013.01); *B01L 2400/0409* (2013.01); *B65D 75/5805* (2013.01); *Y10T 436/25* (2015.01)

(58) Field of Classification Search
None
See application file for complete search history.

(56) References Cited

U.S. PATENT DOCUMENTS

| | | | | |
|---|---|---|---|---|
| 5,772,961 | A * | 6/1998 | Mico | 422/412 |
| 2005/0250199 | A1* | 11/2005 | Anderson et al. | 435/287.2 |
| 2007/0048179 | A1* | 3/2007 | Fujita et al. | 422/57 |
| 2007/0243111 | A1 | 10/2007 | Momose | |
| 2009/0045058 | A1* | 2/2009 | Fujita et al. | 204/451 |
| 2009/0291025 | A1* | 11/2009 | Aoki | 422/68.1 |
| 2013/0132006 | A1* | 5/2013 | Gwynn et al. | 702/55 |

FOREIGN PATENT DOCUMENTS

JP 2007-285792 11/2007

* cited by examiner

*Primary Examiner* — Jill Warden
*Assistant Examiner* — Timothy G Kingan
(74) *Attorney, Agent, or Firm* — Fish & Richardson P.C.

(57) ABSTRACT

Provided is a liquid reagent containing microchip having a fluid circuit formed of a space inside thereof. Liquid present in the fluid circuit is transferred to a desired position in the fluid circuit by applying centrifugal force. The fluid circuit includes a reagent retaining portion for accommodating a liquid reagent. The microchip includes an air introduction path formed of a groove provided on an outer surface of the microchip and coupled to the reagent retaining portion for introducing air into the reagent retaining portion, and a sealing portion provided so as to be detachable from the microchip for sealing the air introduction path. A method of using the microchip and a packaged liquid reagent containing microchip using the microchip are also provided.

3 Claims, 30 Drawing Sheets

LIQUID REAGENT CONTAINING MICROCHIP AND METHOD OF USING THE SAME, AND PACKAGED LIQUID REAGENT CONTAINING MICROCHIP

BACKGROUND OF THE INVENTION

1. Field of the Invention

The present invention relates to a microchip useful as μ-TAS (Micro Total Analysis System) suitably used for biochemical test for DNA, protein, cell, immunity, or blood, chemical synthesis, or environmental analysis. In particular, the present invention relates to a liquid reagent containing microchip in which a liquid reagent to be mixed or reacted with a sample to be tested or analyzed is contained in advance in a reagent retaining portion in the microchip.

2. Description of the Background Art

In recent years, in the fields of medical care, health, food, drug discovery, and the like, detection or quantitation of biological substances such as DNA, enzyme, antigen, antibody, protein, virus, and cell as well as chemical substances has become increasingly important, and various biochips and micro chemical chips (such chips will hereinafter be collectively referred to as microchip) with which the above-described substances can be easily and conveniently measured have been proposed.

The microchip can be used to allow a series of experimental and analytical operations, which are usually performed in a laboratory, to be conducted within the small chip. The microchip accordingly provides many advantages that the amounts of samples and liquid reagents to be used are very small, the cost is low, the reaction rate is high, high throughput test or analysis can be conducted, and the test results can be immediately obtained at the site where the sample was taken, for example.

A known microchip includes a flow path network, called a "fluid circuit" (or "micro fluid circuit"), which is constituted of different kinds of parts (chambers) for performing particular treatments on a sample or liquid such as a liquid reagent present in the circuit, and minute flow paths appropriately connecting these parts (for example, see Japanese Patent Laying-Open No. 2007-285792). In a test or analysis of a sample using the microchip including such a fluid circuit therein, the fluid circuit is used to perform various treatments including measurement of a sample introduced in the fluid circuit (or a specific component in the sample) and a liquid reagent to be mixed with the sample (that is, transfer to a measuring portion that is a part for performing measurement), mixing of the sample (or a specific component in the sample) with the liquid reagent (that is, transfer to a mixing portion that is a part for mixing the sample and the liquid reagent), and transfer from one part to another part.

It is noted that treatments of various liquids (such as a sample, a specific component in the sample, a liquid reagent, or a mixture of two or more kinds thereof) performed in the microchip will hereinafter sometimes be referred to as "fluid treatment". These various fluid treatments can be performed by applying centrifugal force in an appropriate direction to the microchip.

Of the microchips as described above, a liquid reagent containing microchip is a microchip in which a liquid reagent to be mixed or reacted with a sample or a specific component in the sample is retained in advance in the fluid circuit. One or more reagent retaining portions that accommodate the liquid reagent are provided in the fluid circuit of the liquid reagent containing microchip. In the liquid reagent containing microchip, a reagent inlet for pouring the liquid reagent into the reagent retaining portion is generally provided on one surface of the microchip so as to reach the reagent retaining portion.

SUMMARY OF THE INVENTION

The liquid reagent containing microchip is available for a series of fluid treatments including applying centrifugal force in a prescribed direction to the microchip to discharge the liquid reagent from a reagent discharge path coupled to the reagent retaining portion, and introducing the liquid reagent to, for example, the measuring portion for measurement. However, in the conventional liquid reagent containing microchip, when centrifugal force is applied, discharge of the liquid reagent causes reduction in internal pressure in the reagent retaining portion (brings about a reduced pressure state) thereby preventing the liquid reagent from being discharged well from the reagent retaining portion. Such insufficient discharge of the liquid reagent may inhibit precise and reliable test or analysis.

On the other hand, if the sectional area (inner diameter) of the reagent discharge path is increased in order to improve the discharge performance of the liquid reagent during application of centrifugal force, the liquid reagent easily flows out from the reagent retaining portion because of an internal pressure increase in the reagent retaining portion due to an environmental temperature change or an outside atmospheric pressure change after manufacture and before use of the liquid reagent containing microchip. This unintended leakage of the liquid reagent may also inhibit precise and reliable test or analysis.

Therefore, the present invention aims to provide a liquid reagent containing microchip and a packaged liquid reagent containing microchip in which unintended leakage of a liquid reagent after manufacture and before use of the microchip can be prevented effectively while the liquid reagent can be discharged well from a reagent retaining portion during application of centrifugal force (that is, during use of the microchip).

(a) The present invention provides a liquid reagent containing microchip (A) having a fluid circuit formed of a space inside thereof, in which liquid present in the fluid circuit is transferred to a desired position in the fluid circuit by applying centrifugal force. The fluid circuit includes a reagent retaining portion for accommodating a liquid reagent. The microchip includes: an air introduction path formed of a groove provided on an outer surface of the microchip and coupled to the reagent retaining portion for introducing air into the reagent retaining portion; and a sealing portion provided so as to be detachable from the microchip for sealing the air introduction path.

The sealing portion may be, for example, a sealing layer stacked on the outer surface of the microchip so as to cover the air introduction path.

In a preferred embodiment, the fluid circuit includes two or more reagent retaining portions for accommodating a liquid reagent, and the air introduction path consists of two or more first paths coupled to the respective reagent retaining portions. In this embodiment, when the sealing portion is a sealing layer stacked on the outer surface of the microchip so as to cover the air introduction path, the sealing layer preferably has a cut to allow a portion stacked on end portions of the two or more first paths to be cut off.

In another preferred embodiment, the fluid circuit includes two or more reagent retaining portions, and the air introduction path consists of two or more first paths coupled to the respective reagent retaining portions and one second path extending so as to be connected to all of the two or more first paths. In this embodiment, when the sealing portion is a sealing layer stacked on the outer surface of the microchip so as to cover the air introduction path, the sealing layer preferably has a cut to allow a portion stacked on an end portion of the second path to be cut off.

The present invention also provides a method of using the liquid reagent containing microchip (A) described above. The method includes the step of bringing the reagent retaining portion into communication with outside of the microchip through the air introduction path by detaching at least part of the sealing portion from the microchip.

(b) The present invention further provides a packaged liquid reagent containing microchip (B) including a package and the liquid reagent containing microchip (A) accommodated in the package. In the packaged liquid reagent containing microchip (B), the portion of the sealing layer stacked on the end portions of the two or more first paths or the portion of the sealing layer stacked on the end portion of the second path is joined with the package. In the packaged liquid reagent containing microchip (B), part of the sealing layer may be composed of part of the package.

(c) The present invention further provides a liquid reagent containing microchip (C) having a fluid circuit formed of a space inside thereof, in which liquid present in the fluid circuit is transferred to a desired position in the fluid circuit by applying centrifugal force. The fluid circuit includes a reagent retaining portion for accommodating a liquid reagent. The microchip includes: a reagent discharge path coupled to the reagent retaining portion for discharging the liquid reagent; and an air introduction path coupled to the reagent retaining portion for introducing air into the reagent retaining portion, the air introduction path being a flow path different from the reagent discharge path.

In a preferred embodiment, a coupling portion between the reagent retaining portion and the air introduction path is located on a side opposite to a coupling portion between the reagent retaining portion and the reagent discharge path with respect to a fluid level formed by an entire amount of the liquid reagent when centrifugal force in a prescribed direction for discharging the liquid reagent from the reagent discharge path is applied.

In another preferred embodiment, a terminal end of the air introduction path is located on a side opposite to a coupling portion between the reagent retaining portion and the reagent discharge path with respect to a fluid level formed by an entire amount of the liquid reagent when centrifugal force in a prescribed direction for discharging the liquid reagent from the reagent discharge path is applied.

The liquid reagent containing microchip (C) may further include a flow path connecting a coupling portion between the reagent retaining portion and the reagent discharge path with the air introduction path.

In yet another preferred embodiment, a coupling portion between the reagent retaining portion and the air introduction path is in proximity to or in coincident with a coupling portion between the reagent retaining portion and the reagent discharge path. In this case, a terminal end of the air introduction path is preferably located on a side opposite to the coupling portion between the reagent retaining portion and the reagent discharge path with respect to a fluid level formed by an entire amount of the liquid reagent when centrifugal force in a prescribed direction for discharging the liquid reagent from the reagent discharge path is applied.

In the liquid reagent containing microchip (C), a sectional area $\phi_1$ at a terminal end of the reagent discharge path and a sectional area $\phi_2$ at a terminal end of the air introduction path preferably satisfy $\phi_1<\phi_2$.

According to the present invention, unintended leakage of the liquid reagent can be prevented after manufacture and before use of the microchip (for example, during storage or transport). In addition, the liquid reagent can be discharged well from the reagent retaining portion during application of centrifugal force. Thus, a liquid reagent containing microchip and a packaged liquid reagent containing microchip that allow precise and reliable test or analysis can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Overview of Liquid Reagent Containing Microchip

Figure 1:
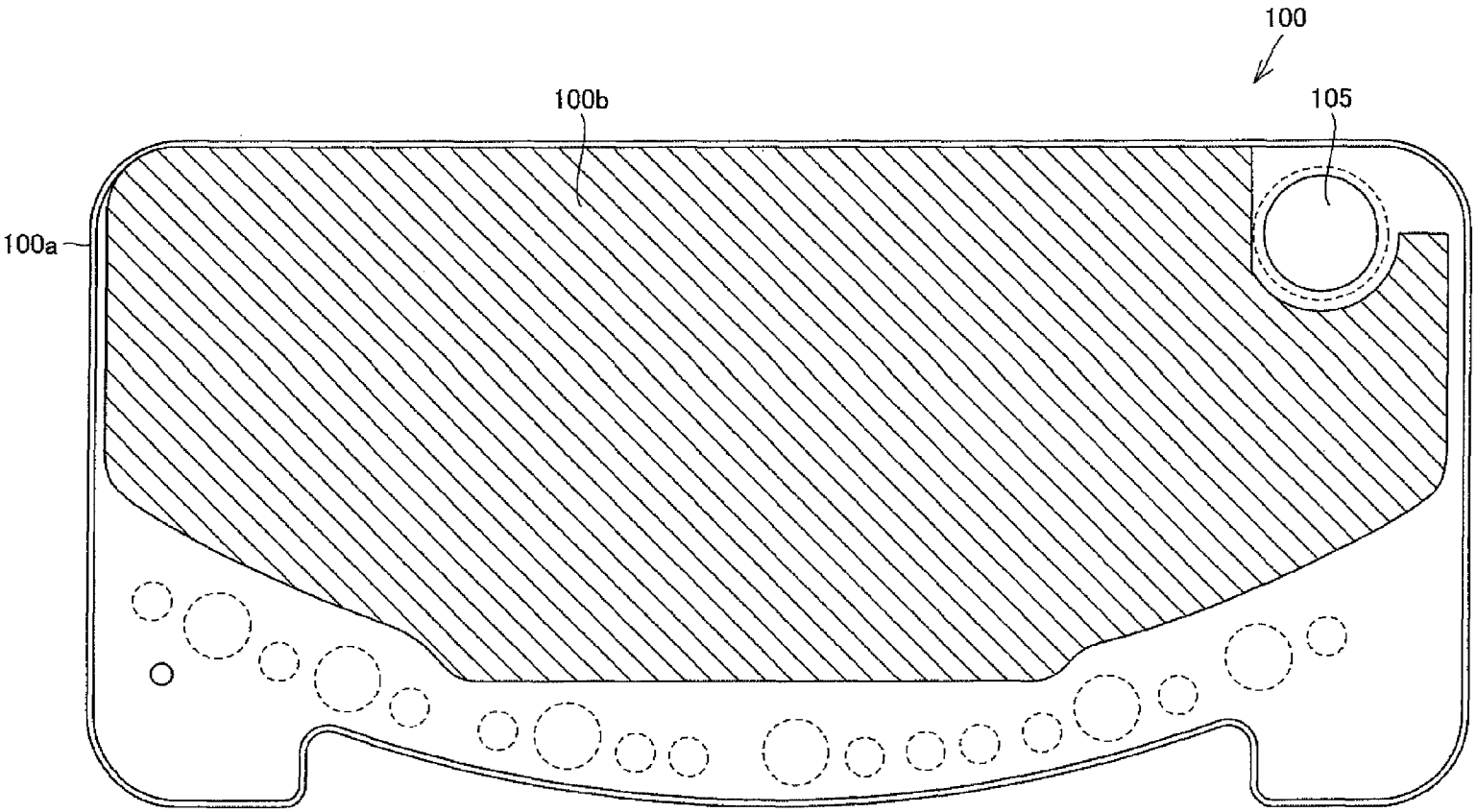
FIG. 1 is a top view of a liquid reagent containing microchip according to a first embodiment as viewed from the first substrate side (sealing layer side).

A liquid reagent containing microchip of the present invention is a chip with which various chemical synthesis, test or analysis is performed using a fluid circuit (a space formed inside) inside the microchip. With the liquid reagent containing microchip of the present invention, appropriate fluid treatments can be performed for liquid in the fluid circuit (for example, a sample, a specific component in the sample, a liquid reagent, or a mixture of two or more kinds thereof) by transferring the liquid to a prescribed position (part) in the fluid circuit by applying centrifugal force. The fluid circuit includes a variety of parts (chambers) arranged at appropriate positions, and these parts are appropriately connected through minute flow paths.

The fluid circuit in the liquid reagent containing microchip of the invention has a reagent retaining portion, as one of the parts (chambers), which accommodates a liquid reagent to be mixed (or reacted) with a sample to be tested or analyzed.

In a liquid reagent containing microchip (A) and a packaged liquid reagent containing microchip (B) using the same, an air introduction path for introducing air into the reagent retaining portion is coupled to the reagent retaining portion, as detailed later. The liquid reagent containing microchip includes a sealing portion provided so as to be detachable from the microchip for sealing the air introduction path. The air introduction path is formed of a groove provided on an outer surface of the microchip. The reagent retaining portion has a reagent discharge path for discharging the liquid reagent accommodated therein.

In a liquid reagent containing microchip (C), a reagent discharge path for discharging a liquid reagent and an air introduction path, which is a flow path different from the reagent discharge path, for introducing air into a reagent retaining portion are coupled to the reagent retaining portion as will be detailed later.

In general, a reagent inlet which is a through hole for pouring a liquid reagent into the reagent retaining portion is provided in one surface of the liquid reagent containing microchip so as to reach the reagent retaining portion. In order to prevent leakage of the liquid reagent, the reagent inlet is sealed after the liquid reagent is poured. The sealing can be performed, for example, by affixing a sealing layer such as a sealing label (seal) on the microchip surface. In the liquid reagent containing microchip (A), this sealing can be performed simultaneously with a sealing portion for sealing the air introduction path.

In addition to the reagent retaining portion as described above, the fluid circuit can mainly include: a separation portion for extracting a specific component from a sample introduced into the fluid circuit; a sample measuring portion for measuring the sample (in some cases, including a specific component in the sample, which is applicable in the following); a reagent measuring portion for measuring a liquid reagent; a mixing portion for mixing the sample with the liquid reagent; a detection portion for performing test or analysis (for example, detection or quantitation of a specific component in the liquid mixture) for the resultant liquid mixture; and a waste storage portion for accommodating waste liquid (for example, the sample or liquid reagent overflowing the sample measuring portion or the reagent measuring portion during measurement).

The method of the test or analysis is not specifically limited. Examples of the method of the test or analysis may include optical measurements including a method of applying light to the detection portion accommodating the liquid mixture, and detecting the intensity of the transmitted light (transmission ratio), and a method of measuring an absorption spectrum for the liquid mixture retained in the detection portion.

The liquid reagent containing microchip of the invention may have all the parts (chambers) illustrated above or may not have any one or more of those parts. The liquid reagent containing microchip of the invention may have a part other than those parts illustrated above. The number of parts is not specifically limited and may be one or two or more.

Various fluid treatments in the fluid circuit, such as extraction of a specific component from a sample (separation of an unnecessary component), measurement of a sample and a liquid reagent, mixing of the sample with the liquid reagent, and introduction of the resultant liquid mixture to the detection portion, can be performed by successively applying centrifugal force in an appropriate direction to the microchip to successively transfer the target liquid to a prescribed part arranged at a prescribed position. For example, the measurement of a sample or a liquid reagent can be carried out by introducing the sample or the liquid reagent to be measured by applying centrifugal force, to the measuring portion having a prescribed capacity (the same capacity as the quantity to be measured), and letting the excessive sample or liquid reagent to overflow the measuring portion. The sample or liquid reagent that overflows can be accommodated in the waste storage portion connected to the measuring portion through a flow path.

Centrifugal force can be applied to the microchip by placing the microchip in a device (centrifugal device) capable of applying centrifugal force. The centrifugal device can include a rotor capable of rotating and a rotatable stage arranged on the rotor. The microchip is placed on the stage and set at a given angle with respect to the rotor by rotating the stage, and the rotor is thereafter rotated. Thus, centrifugal force in a given direction can be applied to the microchip.

The liquid reagent containing microchip of the invention can be configured with a first substrate and a second substrate stacked on and laminated with the first substrate. More specifically, the second substrate having a groove on a surface can be laminated on the first substrate such that the surface with the groove of the second substrate faces the first substrate. The microchip formed of two substrates has a fluid circuit formed of an internal space configured with the groove provided on the surface of the second substrate and the surface of the first substrate on the side facing the second substrate. The shape and the pattern of the groove formed on the surface of the second substrate are determined such that the structure of the internal space achieves an appropriate fluid circuit structure as desired.

The liquid reagent containing microchip of the invention may be formed by stacking a first substrate, a second substrate having grooves provided on both surfaces of the substrate, and a third substrate, in this order, and laminating those substrate together. The microchip including three substrates has a two-layer fluid circuit including a first fluid circuit formed of an internal space configured with the surface of the first substrate on the side facing the second substrate and the groove provided on the surface of the second substrate on the side facing the first substrate, and a second fluid circuit formed of an internal space configured with the surface of the third substrate on the side facing the second substrate and the groove provided on the surface of the second substrate on the side facing the third substrate. Here, "two-layer" means that fluid circuits are provided at different two positions with respect to the thickness direction of the microchip. The two layers of the fluid circuit can be connected with each other through a through hole passing through the second substrate in the thickness direction.

The method of laminating the substrates is not specifically limited, and examples thereof may include a method of fusing and welding the laminated surface of at least one of the substrates to be laminated (welding method), and a method of bonding using adhesive. Examples of the welding method may include a method of welding by heating the substrate, a method of applying light such as laser beams and welding by heat produced in light absorption (laser welding), and a method of welding by ultrasonic waves. Among those, the laser welding is preferably used.

The size of the liquid reagent containing microchip of the present invention is not specifically limited and, for example, may be about a few centimeters in length and width and about a few millimeters to one centimeter in thickness.

The material of each substrate that constitutes the liquid reagent containing microchip of the present invention is not specifically limited. Examples of the material used may include thermoplastic resins such as polyethylene terephthalate (PET), polybutylene terephthalate (PBT), polymethylmethacrylate (PMMA), polycarbonate (PC), polystyrene (PS), polypropylene (PP), polyethylene (PE), polyethylene naphthalate (PEN), polyarylate (PAR) resin, acrylonitrile-butadiene-styrene (ABS) resin, polyvinyl chloride (PVC) resin, polymethylpentene (PMP) resin, polybutadiene (PBD) resin, biodegradable polymer (BP), cycloolefin polymer (COP), and polydimethylsiloxane (PDMS)

In the case where the microchip is configured with the first substrate and the second substrate having a groove on the surface of the substrate, the second substrate is preferably a transparent substrate in order to construct a detection portion for optical measurement using detection light. The first substrate may be either a transparent substrate or an opaque substrate. When laser welding is performed, an opaque substrate is preferred because the optical absorption ratio can be increased. In this case, preferably, a black substrate is preferred, which is obtained by forming the substrate with resin and adding black pigment such as carbon black in the resin.

In the case where the microchip is configured with the first substrate, the second substrate having grooves on both surfaces of the substrate, and the third substrate, the second substrate is preferably an opaque substrate, more preferably a black substrate, from the viewpoint of efficiency of laser welding. On the other hand, the first and third substrates are preferably transparent substrates in order to construct a detection portion for optical measurement using detection light. When the first and third substrates are transparent substrates, a detection portion for optical measurement can be formed with a through hole provided in the second substrate and with the transparent first and third substrates. In this case, optical measurement can be performed, for example, by applying detection light to the detection portion from the direction approximately vertical to the microchip surface and detecting the intensity of the transmitted light (transmission ratio).

The method of forming a groove (pattern groove) that constitutes the fluid circuit is not specifically limited. Examples of the method thereof may include an injection molding method using a mold having a transfer structure, and an imprint method. When the substrate is formed using an inorganic material, an etching method can be used. The shape of the groove is determined so as to achieve an appropriate fluid circuit structure.

It is noted that a groove that constitutes the fluid circuit, a groove or concave portion (excluding the air introduction path for the liquid reagent containing microchip (A)) formed on the outer surface, a through hole, etc. can also be provided as appropriate in the substrates (the first and/or third substrates) excluding the second substrate.

The liquid reagent containing microchips (A) and (C) and the packaged liquid reagent containing microchip (B) of the present invention will be described in more details below with illustration of embodiments.

First Embodiment

The present embodiment relates to the liquid reagent containing microchip (A). An example of the liquid reagent containing microchip and the substrates that constitute this microchip according to the present embodiment is shown in FIG. 1 to FIG. 5. A liquid reagent containing microchip 100 shown in these drawings is configured with: a microchip body 100*a* formed by stacking a first substrate 1 that is a transparent substrate, a second substrate 2 that is a black substrate having grooves on both surfaces for forming a fluid circuit, and a third substrate 3 that is a transparent substrate, in this order, and laminating those substrates together; and a sealing layer 100*b*, serving as the sealing layer described above, stacked on an outer surface of the first substrate 1.

Figure 2:
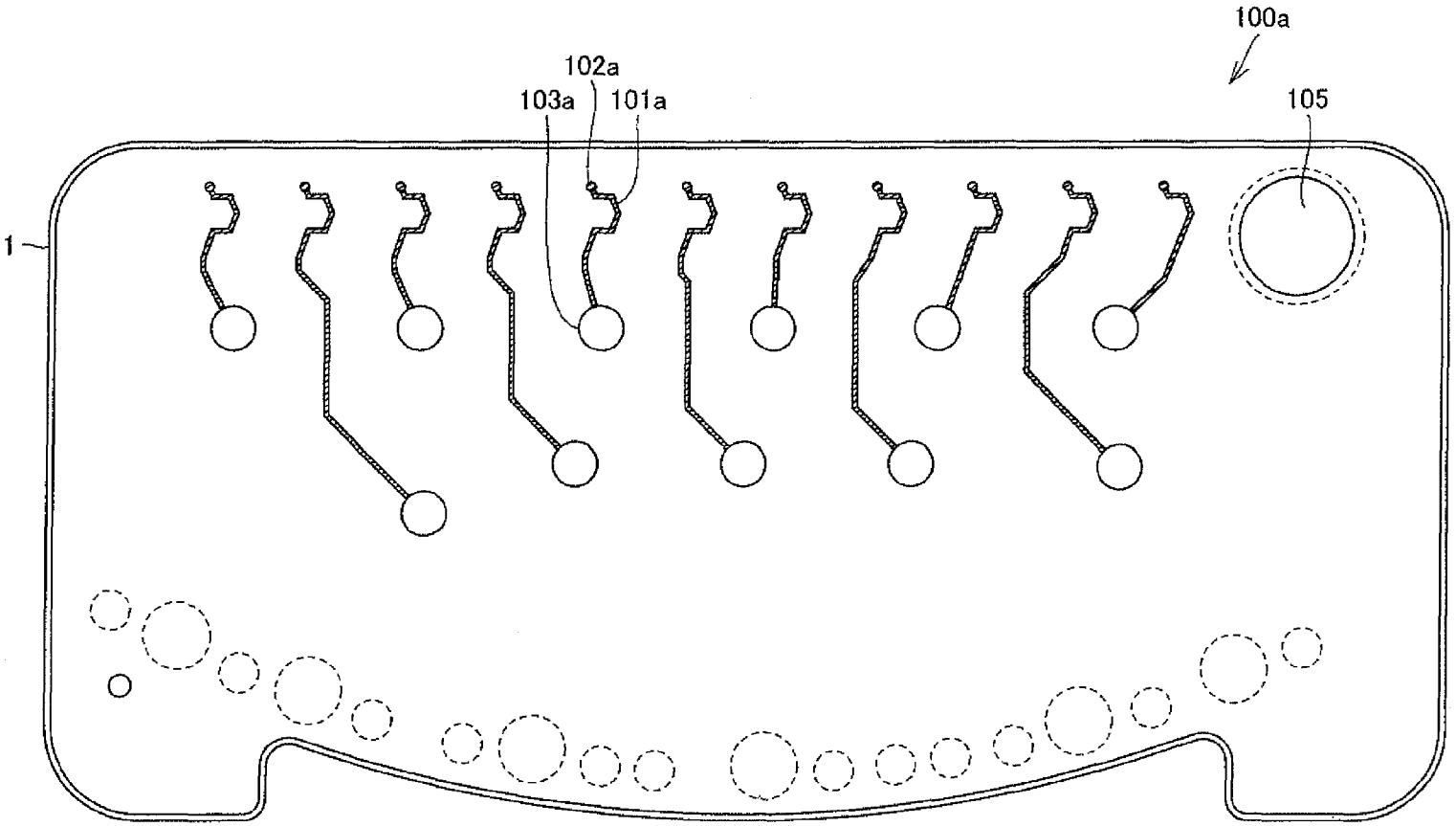
FIG. 2 is a top view showing an outer surface of a first substrate that constitutes the liquid reagent containing microchip according to the first embodiment.

FIG. 1 is a top view of the liquid reagent containing microchip 100 as viewed from the first substrate 1 side (the sealing layer 100*b* side). FIG. 2 is a top view showing the outer surface (the surface opposite to the second substrate 2 side) of the first substrate 1 that constitutes the liquid reagent containing microchip 100 (the microchip body 100*a*), that is, a top view showing the outer surface of the first substrate 1 with the sealing layer 101*b* stripped off from the liquid reagent containing microchip 100.

Figure 3:
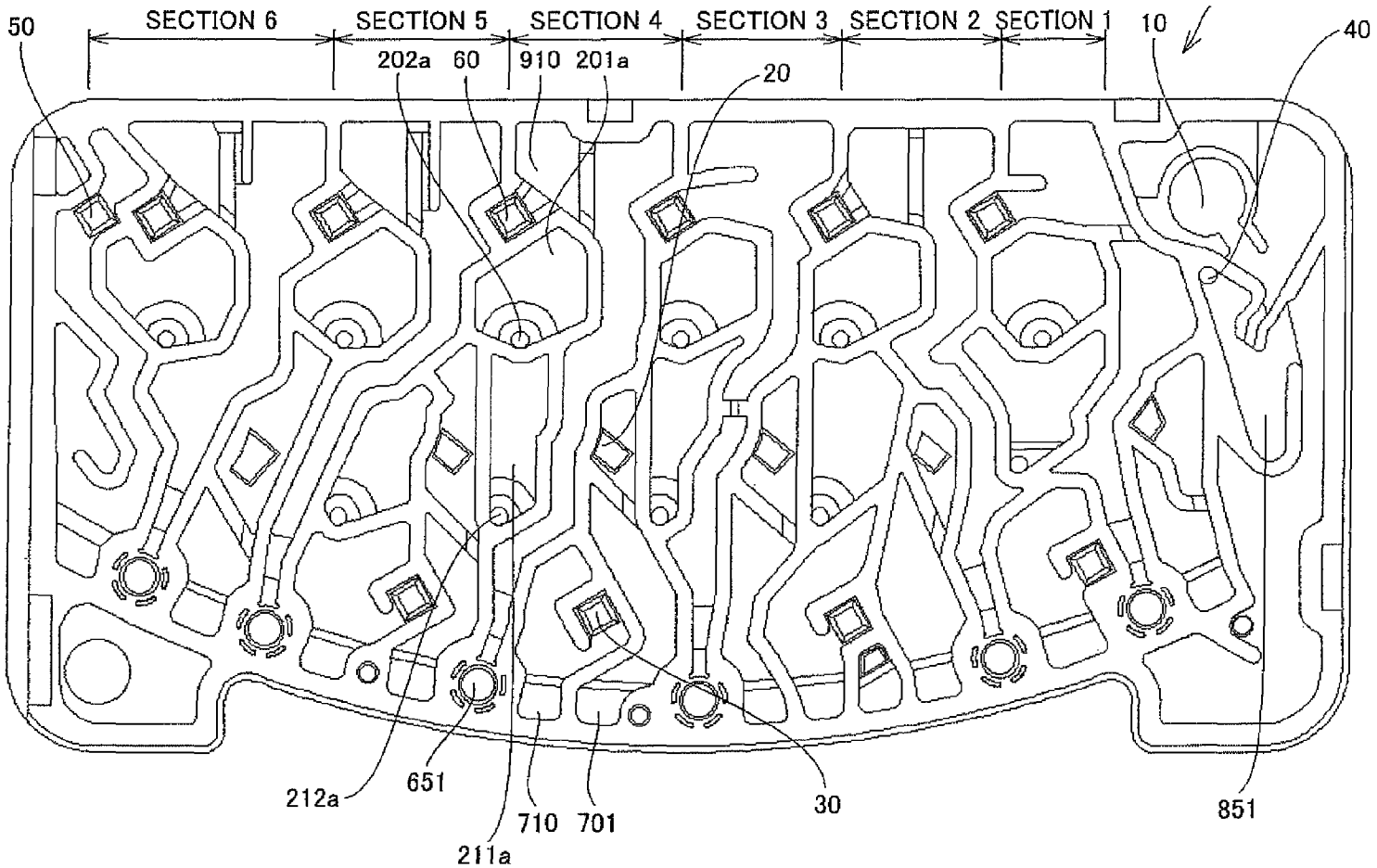
FIG. 3 is a top view showing a surface on the first substrate side of a second substrate that constitutes the liquid reagent containing microchip according to the first embodiment.
Figure 4:
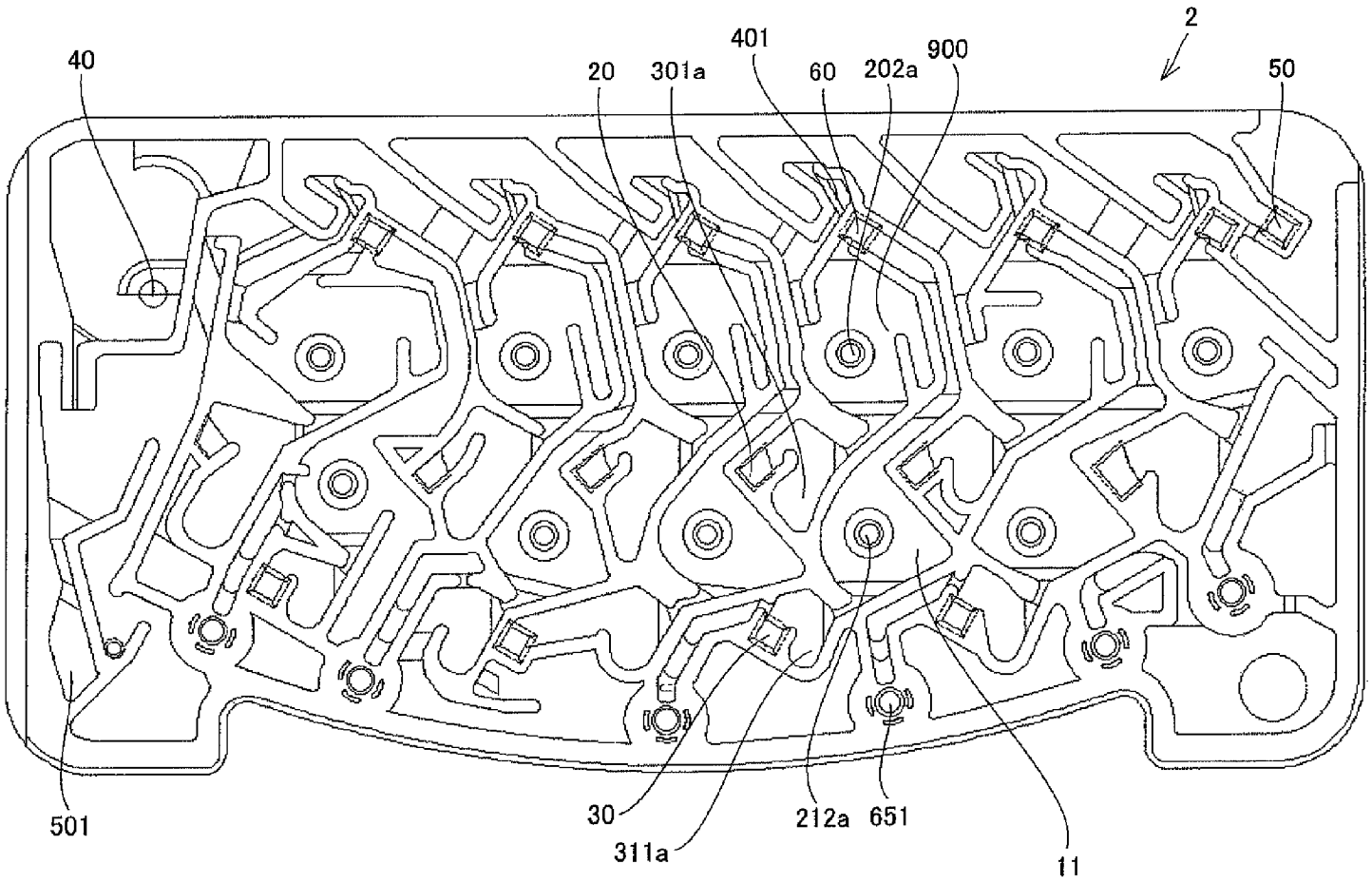
FIG. 4 is a top view showing a surface on the third substrate side of the second substrate that constitutes the liquid reagent containing microchip according to the first embodiment.
Figure 5:
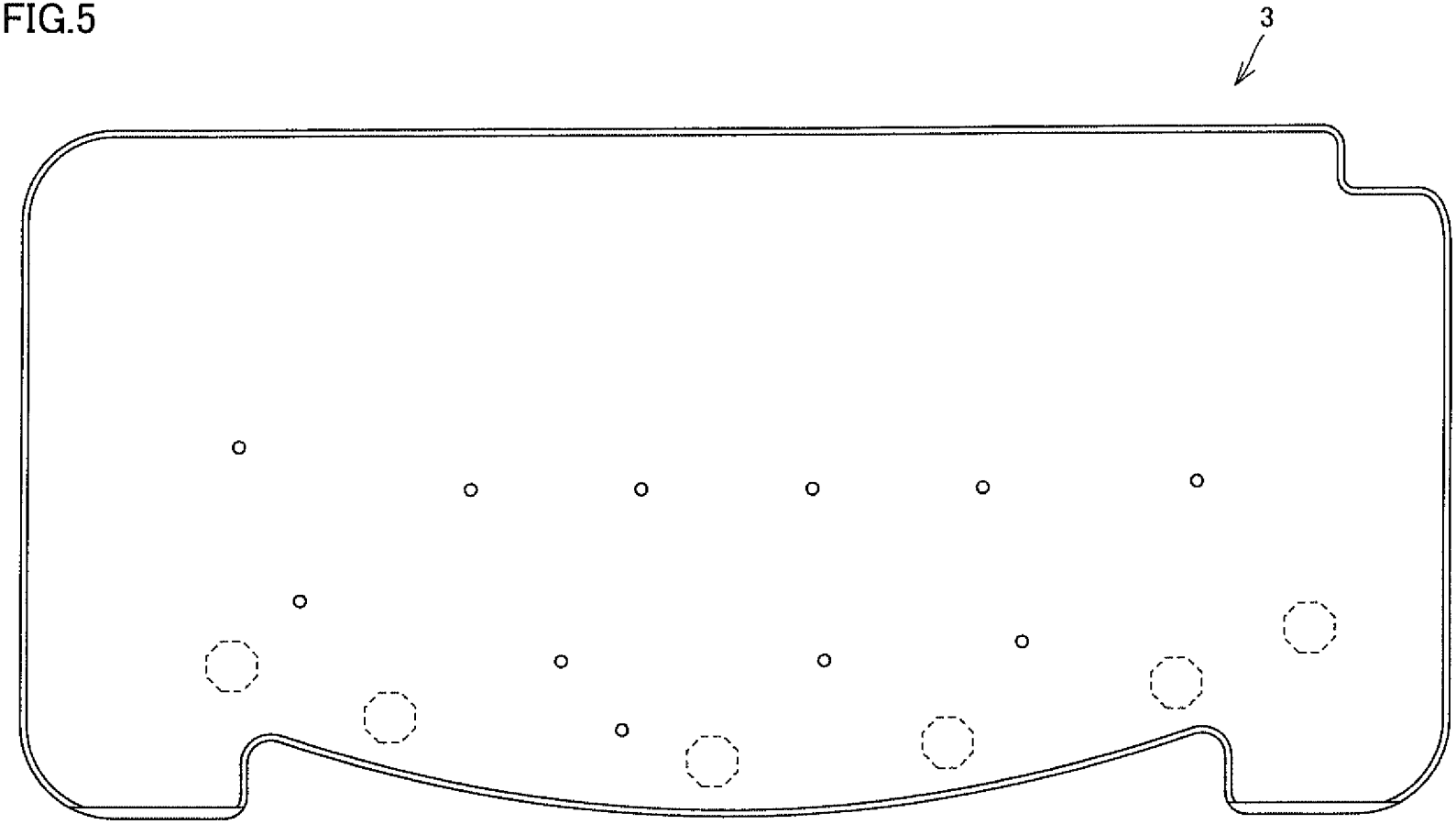
FIG. 5 is a top view showing an outer surface of a third substrate that constitutes the liquid reagent containing microchip according to the first embodiment.

FIG. 3 is a top view showing a surface on the first substrate 1 side of the second substrate 2, FIG. 4 is a top view showing a surface on the third substrate 3 side of the second substrate 2, and FIG. 5 is a top view showing an outer surface (the surface opposite to the second substrate 2 side) of the third substrate 3. In FIGS. 1, 2, and 5, a dotted line means that a region encircled by the dotted line forms a concave portion.

First, the first substrate 1 will be described. Referring to FIG. 2, the first substrate 1 includes, in total, eleven reagent inlets including a reagent inlet 103*a*. These reagent inlets are through holes passing through the first substrate 1 in the thickness direction, and are provided immediately above their respective eleven reagent retaining portions included in the fluid circuit and are connected thereto.

An air introduction path (in total, eleven air introduction paths equivalent to the number of the reagent retaining portions) for introducing air into the reagent retaining portion extends from each reagent inlet. The air introduction path is formed of a groove provided on the outer surface of the first substrate 1 (the outer surface of the microchip). For example, an air introduction path 101*a* extends from the reagent inlet 103*a* and has an end portion connected to an air introduction concave portion 102*a*. The air introduction concave portion 102*a* is a concave portion provided on the outer surface of the first substrate 1 and is in communication with the air introduction path 101*a*. The air introduction path 101*a* is coupled to a reagent retaining portion 201*a* (see FIG. 3) through the reagent inlet 103*a* (this is applicable to the other introduction paths). The air introduction paths extending from the respective reagent inlets have their lengths adjusted such that their end portions (thus, the respective air introduction concave portions) are arranged approximately in a row. In the present embodiment, the air introduction path is formed of only a first path extending from each reagent inlet. The first path means a groove directly coupled to the reagent retaining portion through a through hole such as the reagent inlet.

In the first substrate 1, a sample introduction port 105 is also provided, which is a through hole passing through the first substrate 1 in the thickness direction for introducing a sample (for example, blood) into the fluid circuit. After a liquid reagent is poured from the reagent inlets, the sealing layer 100*b* is stacked on the outer surface of the first substrate 1 to cover and seal all the air introduction paths and the air introduction concave portions (the air introduction concave portions may be omitted as described later) and to seal all the reagent inlets. Thus, the liquid reagent containing microchip 100 of the present embodiment can be obtained (see FIG. 1).

The sealing layer 101*b* has such a size and a shape that can cover all of the air introduction paths, the air introduction concave portions, and the reagent inlets on the first substrate 1, and can be stripped off from the microchip body 100*a* (the first substrate 1) during use of the microchip. Specifically, a plastic film (for example, a label or a seal) having an adhesive layer on one surface can be used.

The fluid circuit of the liquid reagent containing microchip 100 of the present embodiment will now be described. Referring to FIG. 3 and FIG. 4, the second substrate 2 has grooves formed on both surfaces thereof and a plurality of through holes passing through the thickness direction. The first substrate 1 and the third substrate 3 are laminated with the second substrate 2, whereby a two-layer fluid circuit is formed inside the microchip. In the following description, the fluid circuit configured with the surface on the second substrate 2 side of the first substrate 1 and the groove provided on the surface on the first substrate 1 side of the second substrate 2 is referred to as a "first fluid circuit," and the fluid circuit configured with the surface on the second substrate 2 side of the third substrate 3 and the groove provided on the surface on the third substrate 3 side of the second substrate 2 is referred to as a "second fluid circuit." These two fluid circuits are coupled to each other through several through holes formed in the second substrate 2 and passing through the thickness direction.

The structure of the first fluid circuit can be understood from FIG. 3, and the structure of the second fluid circuit can be understood from FIG. 4. The liquid reagent containing microchip 100 of the present embodiment is a multi-item chip that allows tests or analyses for six items for one sample. The fluid circuit is divided into six sections [section 1 to section 6 in FIG. 3 (the first fluid circuit), which is applicable to FIG. 4 (the second fluid circuit)] to allow tests and analyses for six items. It is noted that these sections are connected with each other in a sample measuring portion installation region (the upper region of the second fluid circuit shown in FIG. 4).

The sections described above have a similar configuration, and the fluid treatments therein are also similar. Therefore, "section 4" is mainly described below as an example.

In section 4, two reagent retaining portions containing a liquid reagent are provided in the first fluid circuit (reagent retaining portions 201*a* and 211*a* in FIG. 3). As described above, the reagent inlet that is a through hole passing through the first substrate 1 in the thickness direction is provided (the reagent inlet 103*a* in FIG. 2 and the reagent inlet below it) in each reagent retaining portion. Reagent discharge paths 202*a* and 212*a* for discharging the liquid reagent in the reagent retaining portions are coupled to the lower ends of the respective reagent retaining portions (see FIG. 3). The reagent discharge paths 202*a* and 212*a* are through holes extending in the thickness direction of the second substrate 2 and connect to the second fluid circuit on the back side. The liquid reagent discharged from the reagent retaining portions 201*a* and 211*a* by centrifugal force downward in FIG. 3 is introduced to reagent measuring portions 301*a* and 311*a*, respectively, in the second fluid circuit and is measured (see FIG. 4).

In section 4, a sample measuring portion 401 for measuring a specific component in the sample is provided in the second fluid circuit. Such a sample measuring portion is provided for each section. The sample measuring portions are connected in series through flow paths (see FIG. 4).

The liquid reagent containing microchip 100 further includes a separation portion 501 for removing a specific component (a component to be mixed with the liquid reagent) from the sample introduced into the microchip (for example, for separating a blood cell component from whole blood and extracting a plasma component) (see FIG. 4). The separation operation is performed by centrifugal separation.

The sample introduced from the sample introduction port 105 has a specific component removed by the separation portion 501 and is thereafter distributed to each section and measured by the sample measuring portion (for example, the sample measuring portion 401 in section 4). Then, the sample is mixed with one or two kinds of liquid reagent separately measured in each section and is introduced to each detection portion (for example, a detection portion 651 in section 4) (see FIG. 3 and FIG. 4). The liquid mixture introduced to the detection portion is subjected to, for example, optical measurement of applying detection light to the detection portion from the direction approximately vertical to the microchip surface and measuring the transmission ratio of the transmitted light. Thus, for example, a specific component in the liquid mixture is detected.

The liquid reagent containing microchip 100 of the present embodiment can effectively prevent unintended leakage of the liquid reagent after manufacture and before use of the microchip while allowing the liquid reagent to be discharged well from the reagent retaining portion during application of centrifugal force (during use of the microchip). In other words, after manufacture and before use of the microchip (for example, during storage or transport), all of the air introduction paths and the air introduction concave portions serving a function of introducing air into the reagent retaining portions are sealed with the sealing layer 100*b*, so that discharge of the liquid reagent from the reagent discharge paths is effectively prevented (the liquid reagent is hardly discharged because discharge of the liquid reagent involves reduction of internal pressure in the reagent retaining portions).

On the other hand, the sealing layer 100*b* is a layer that can be stripped off. Therefore, during use of the microchip, at least part of the sealing layer 100*b*, specifically, a portion stacked on the end portion of each first path, is stripped off to open the air introduction path and/or the air introduction concave portion, whereby the reagent retaining portion is brought into communication with the outside of the microchip through the air introduction path, thereby allowing air to be introduced into the reagent retaining portion. Accordingly, when centrifugal force in a prescribed direction for discharging the liquid reagent from the reagent discharge path is applied, air is supplied from the air introduction path with discharge of the liquid reagent. Thus, internal pressure reduction does not occur in the reagent retaining portion. Therefore, even when the sectional area of the reagent discharge path is reduced enough to prevent unintended leakage of the liquid reagent from the reagent discharge path after manufacture and before use of the microchip (for example, during storage or transport), the liquid reagent can be discharged well (smoothly).

The sectional shape of the air introduction path 101*a* (applicable to the other air introduction paths) is not specifically limited and may be rectangular, square, or semicircular. The groove width can be, for example, 50 to 1000 μm. In the liquid reagent containing microchip 100, one end of the air introduction path is connected to the reagent inlet, although the present invention is not limited thereto. A through hole different from the reagent inlet may be separately provided so as to pass through the first substrate 1 in the thickness direction, and one end of the air introduction path may be connected to this through hole.

In the liquid reagent containing microchip 100, the air introduction concave portion is connected to the end portion (the end portion on the side opposite to the reagent retaining portion) of the air introduction path (for example, the air introduction concave portion 102*a* for the air introduction path 101*a*). However, the air introduction concave portion is not necessarily provided.

In order to prevent unintended leakage of liquid reagent from the reagent discharge path after manufacture and before use of the microchip, the sectional area of the reagent discharge path is preferably 100 to 500,000 $\mu m^2$, more preferably 100 to 10,000 $\mu m^2$.

A test or analysis method (fluid treatment operation) of a sample (whole blood will be taken as an example) by the liquid reagent containing microchip 100 will be described as follows, mainly taking "section 4" as an example. The following fluid treatment operation is carried out after stripping off at least part of the sealing layer 100*b* to make all the air introduction concave portions (or additionally at least part of the respective air introduction paths, or at least part of the air introduction paths in the absence of the air introduction concave portions) open to the outside of the microchip (that is, after bringing the reagent retaining portions into communication with the outside of the microchip through the air introduction paths).

(1) Whole Blood Introduction and Liquid Reagent Measuring Process

Whole blood is introduced from the sample introduction port 105 of the first substrate 1. Then, centrifugal force is applied in the approximately downward direction in FIG. 3. Thus, whole blood passes through a region 10 and is introduced to an accommodation portion 851 (see FIG. 3). Furthermore, with the application of centrifugal force in the approximately downward direction, the liquid reagent in the reagent retaining portions 201*a* and 211*a* passes through the reagent discharge paths 202*a* and 212*a* and reaches the reagent measuring portions 301*a* and 311*a*, respectively, and is measured (see FIG. 4). The liquid reagent that overflows the reagent measuring portions passes through through holes 20 and 30 and is accommodated in waste storage portions 701 and 710, respectively (see FIG. 3).

In relation to this step, the liquid reagent discharge performance was confirmed using a colored water solution as the liquid reagent. Then, it was confirmed that with application of centrifugal force (3000 rpm, 15 seconds) in the approximately downward direction as described above, the entire amount of the liquid reagent was discharged well from all the reagent retaining portions and introduced into the reagent measuring portions.

(2) Centrifugal Separation Process

Next, after centrifugal force is applied in the approximately leftward direction in FIG. 3, centrifugal force is applied in the approximately downward direction to introduce whole blood in the accommodation portion 851 to the separation portion 501 through a through hole 40 (see FIG. 4). Then, centrifugal separation is performed in the separation portion 501 by continuously applying the centrifugal force in the approximately downward direction. The whole blood is thus separated into a plasma component (upper layer) and a blood cell component (lower layer).

(3) Sample Measuring Process

Next, centrifugal force in the approximately rightward direction in FIG. 4 is applied. Thus, the plasma component separated in the separation portion 501 is introduced to the sample measuring portion 401 (simultaneously introduced to the other five sample measuring portions) and measured (see FIG. 4). The plasma component overflowing the sample measuring portion moves to the first fluid circuit through a through hole 50 (see FIG. 3). This centrifugal force in the approximately rightward direction allows the liquid reagent in the reagent measuring portion 301*a* to move to a mixing portion 900 and allows the liquid reagent in the reagent measuring portion 311*a* to move to a region 11 (see FIG. 4).

(4) First Mixing Process

Next, centrifugal force in the approximately downward direction in FIG. 4 is applied. Thus, the measured liquid reagent (the liquid reagent retained in the reagent retaining portion 201*a*) and the plasma component measured in the sample measuring portion 401 are mixed together in the reagent measuring portion 301*a* (a first step in the first mixing step, see FIG. 4). Next, by applying centrifugal force in the approximately rightward direction in FIG. 4, the liquid mixture is further mixed with the liquid reagent left in the mixing portion 900 (a second step in the first mixing step, see FIG. 4). The first step and the second step are performed multiple times as necessary to ensure mixing.

(5) Second Mixing Process

Next, centrifugal force in the approximately upward direction in FIG. 4 is applied. Thus, the liquid mixture in the mixing portion 900 reaches a mixing portion 910 through a through hole 60, and the other liquid reagent measured (the liquid reagent retained in the reagent retaining portion 211*a*) also reaches the mixing portion 910 through the through hole 60. Those liquid mixture and liquid reagent are mixed together (a first step in the second mixing step, see FIG. 3 and FIG. 4). Next, centrifugal force in the approximately rightward direction in FIG. 3 is applied to allow the liquid mixture to move inside the mixing portion 910, thereby promoting the mixing (a second step in the second mixing step, see FIG. 3). The first step and the second step are performed multiple times as necessary to ensure mixing.

(6) Detection Portion Introduction Process

Finally, centrifugal force in the approximately downward direction in FIG. 3 is applied. Thus, the liquid mixture in the mixing portion 910 is introduced to the detection portion 651. The liquid mixture charged in the detection portion 651 is subjected to optical measurement for testing or analyzing the sample (the plasma component). For example, a specific component in the liquid mixture is detected by applying light from the direction approximately vertical to the microchip surface and measuring the transmitted light. This is applicable to the liquid mixture introduced to the other detection portions.

Second Embodiment

Figure 6:
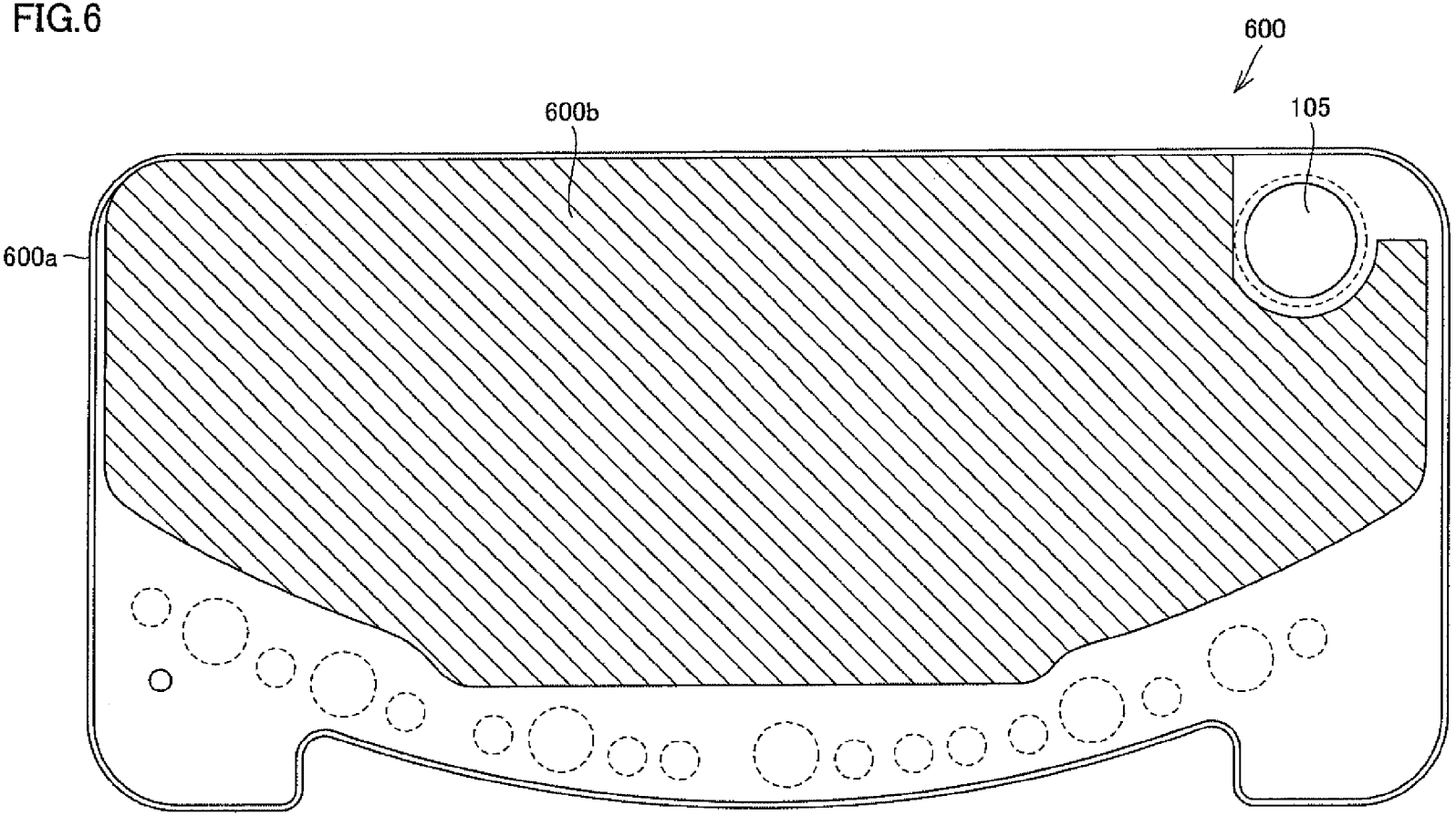
FIG. 6 is a top view of a liquid reagent containing microchip according to a second embodiment as viewed from the first substrate side (sealing layer side).
Figure 7:
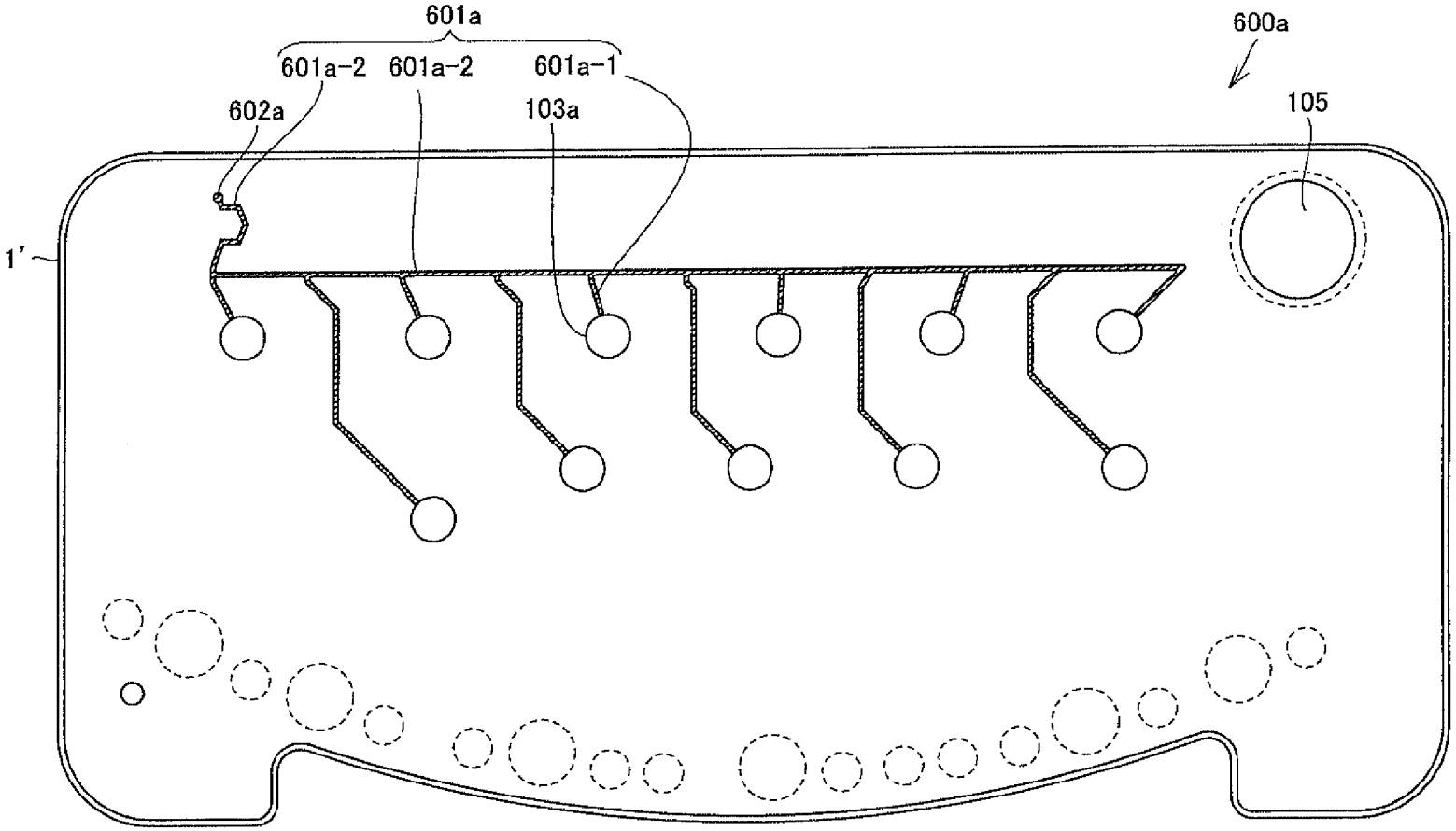
FIG. 7 is a top view showing an outer surface of a first substrate that constitutes the liquid reagent containing microchip according to the second embodiment.

The present embodiment also relates to the liquid reagent containing microchip (A). FIG. 6 is a top view of a liquid reagent containing microchip 600 according to the present embodiment as viewed from the first substrate 1' side (the sealing layer 600*b* side). FIG. 7 is a top view showing an outer surface (the surface opposite to the second substrate side) of a first substrate 1' that constitutes the liquid reagent containing microchip 600 (a microchip body 600*a*) shown in FIG. 6. The liquid reagent containing microchip 600 is characterized by using the microchip body 600*a* having an air introduction path as shown in FIG. 7. The other configuration of the microchip body 600*a* may be the same as that of the microchip body 100*a* in the first embodiment. The sealing layer 600*b* may also be the same as the sealing layer 100*b* in the first embodiment.

Referring to FIG. 7, an air introduction path 601*a* in the present embodiment is comprised of first paths 601*a*-1 (in total, eleven first paths equivalent to the number of the reagent retaining portions) extending from the respective reagent inlets (for example, a reagent inlet 103*a*), and a single second path 601*a*-2 extending so as to be connected to all of the first paths 601*a*-1. An end portion of the second path 601*a*-2 is connected to an air introduction concave portion 602*a*. In other words, in the present embodiment, the first paths 601*a*-1 extending from the respective reagent inlets are unified by the second path 601*a*-2, so that the air introduction path 601*a* has only one end portion, which is connected to only one air introduction concave portion 602*a*.

In this manner, even when a plurality of reagent retaining portions are provided, the end portions of the air introduction paths are unified into one. Therefore, all the reagent retaining portions can be brought into communication with the outside of the microchip by stripping off the sealing layer at a portion stacked on this unified end portion. Accordingly, the operation of stripping off the sealing layer can be simple.

Third Embodiment

Figure 8:
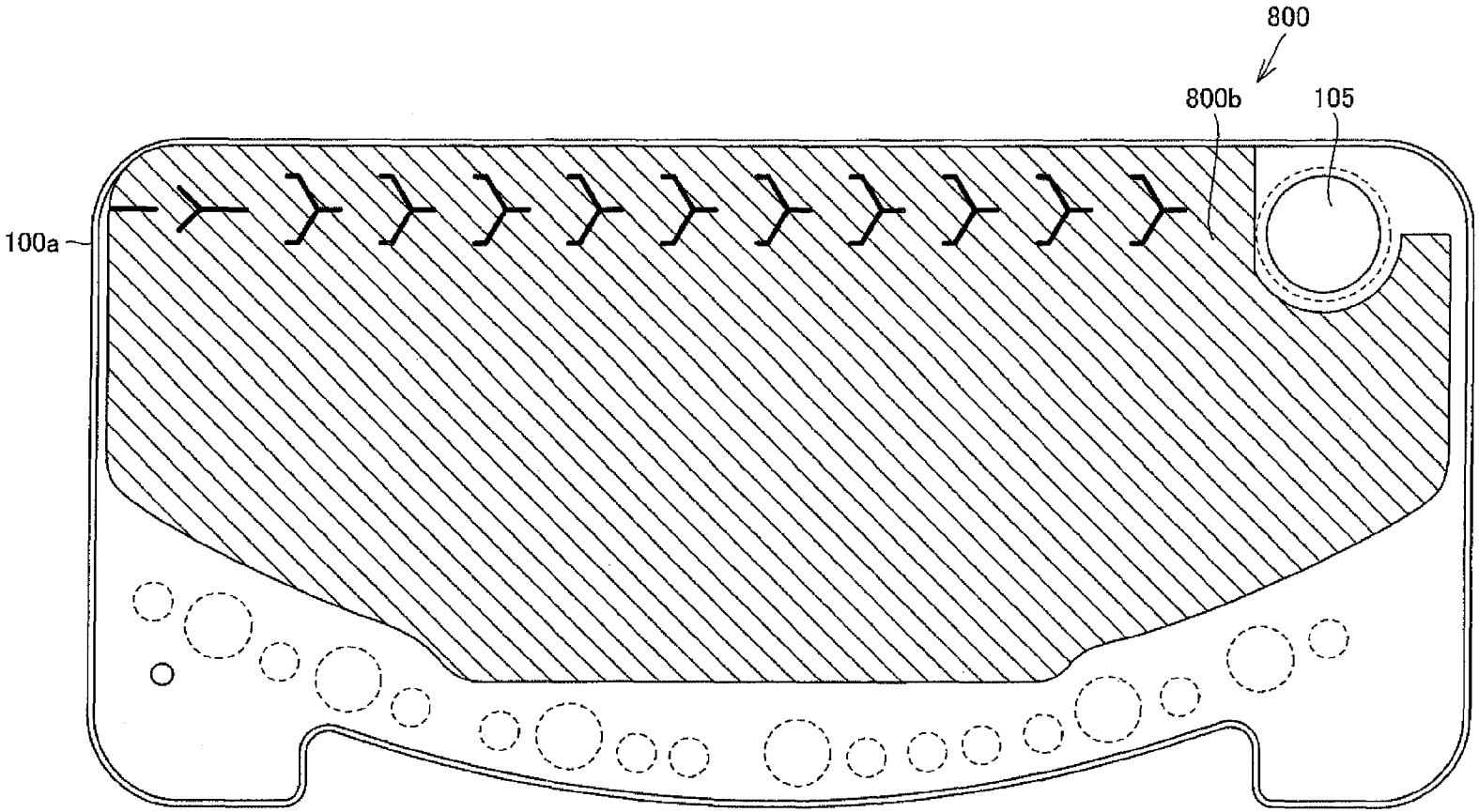
FIG. 8 is a top view of a liquid reagent containing microchip according to a third embodiment as viewed from the first substrate side (sealing layer side).
Figure 9:
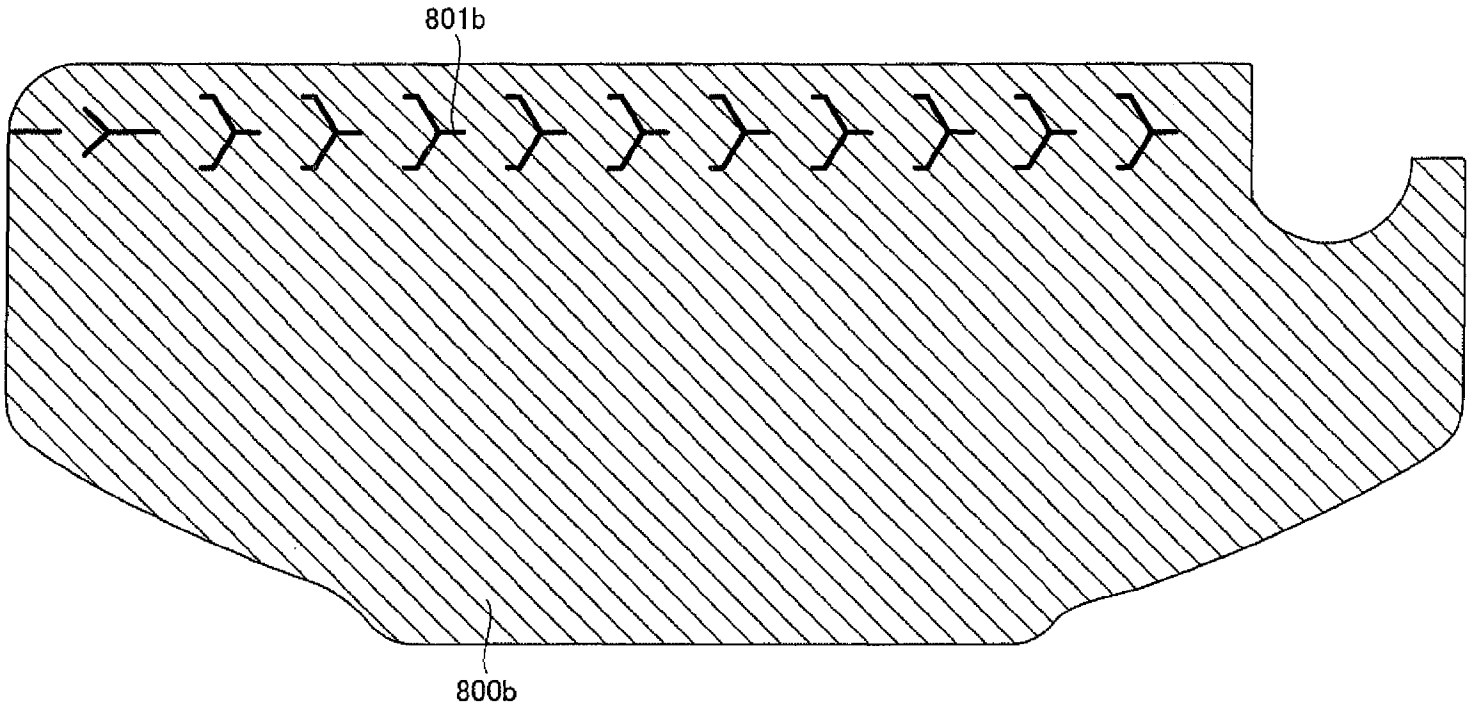
FIG. 9 is a top view showing a sealing layer used in the liquid reagent containing microchip according to the third embodiment.

The present embodiment also relates to the liquid reagent containing microchip (A). FIG. 8 is a top view of a liquid reagent containing microchip 800 according to the present embodiment as viewed from the first substrate side (the sealing layer 800*b* side). FIG. 9 is a top view showing a sealing layer 800*b* used in the liquid reagent containing microchip 800 shown in FIG. 8. The liquid reagent containing microchip 800 is characterized by using the sealing layer 800*b* having a cut 801*b* arranged linearly on the upper portion thereof as shown in FIG. 9. The microchip body is the same as the microchip body 100*a* in the first embodiment.

Figure 10:
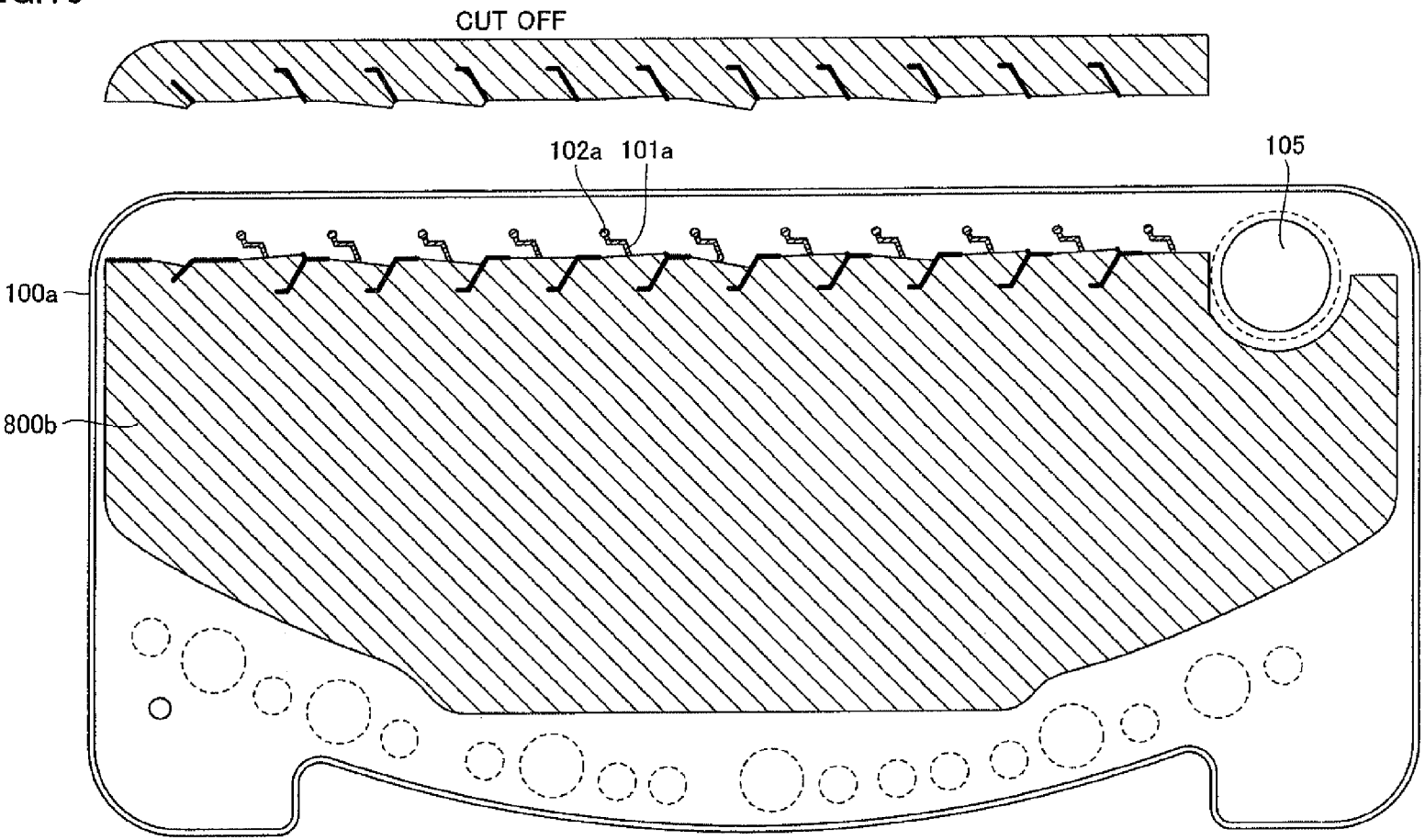
FIG. 10 is a top view showing the liquid reagent containing microchip according to the third embodiment with an upper portion of the sealing layer cut off along a cut.

In the microchip body 100*a*, the end portions of the air introduction paths (the first paths) (and the air introduction concave portions) are arranged generally in a row at the upper portion of the microchip body 101*a*. Therefore, when the sealing layer 800*b* having the cut 801*b* to allow the upper portion of the sealing layer to be easily detached (cut off) is employed, as shown in FIG. 10, the sealing layer at a portion stacked on the end portions of all the air introduction paths (and all the air introduction concave portions) can be easily stripped off, and all the air introduction paths (and all the air introduction concave portions) can be opened to the outside of the microchip. Therefore, the operation of stripping off the sealing layer can be simpler.

Fourth Embodiment

Figure 11:
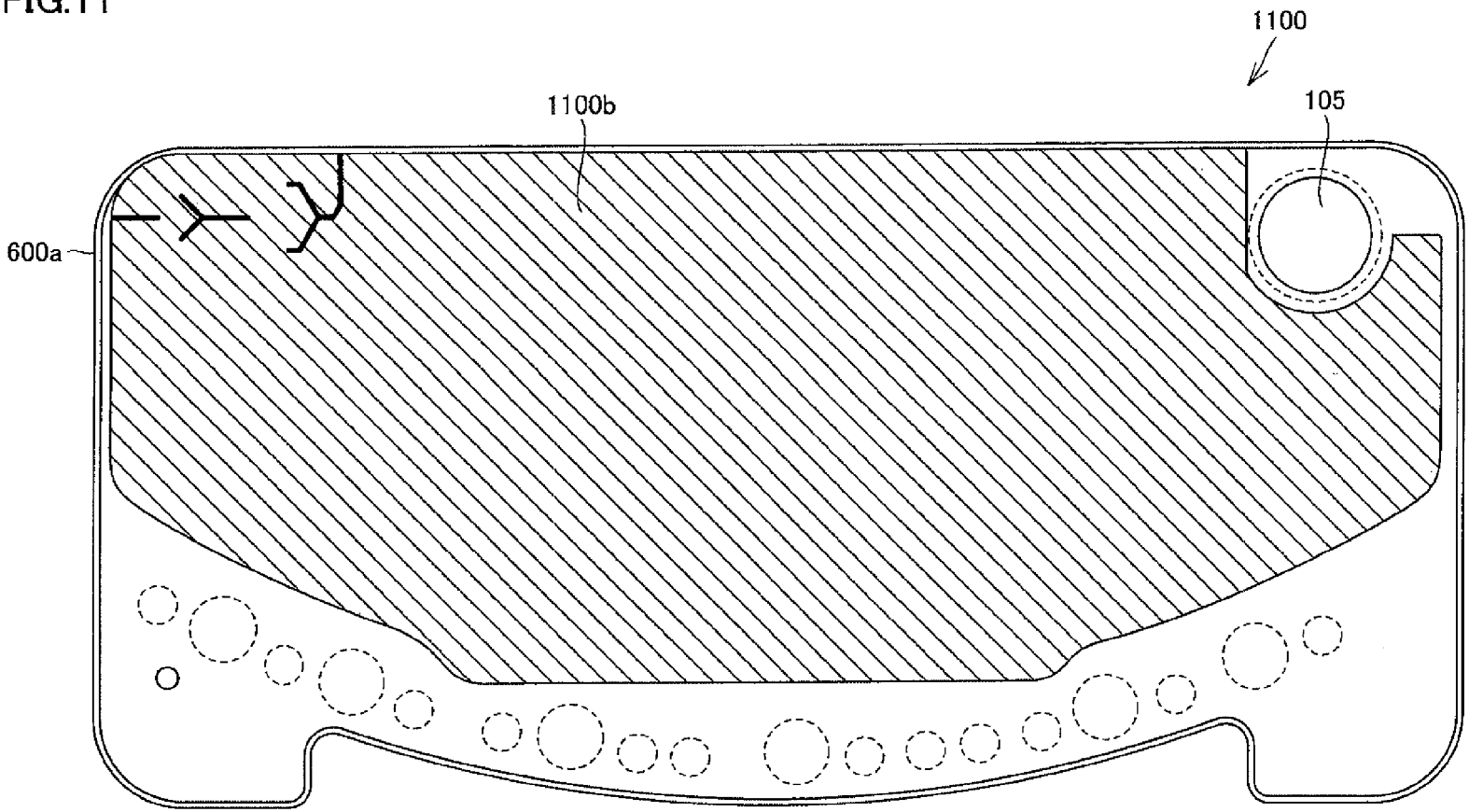
FIG. 11 is a top view of a liquid reagent containing microchip according to a fourth embodiment as viewed from the first substrate side (sealing layer side).
Figure 12:
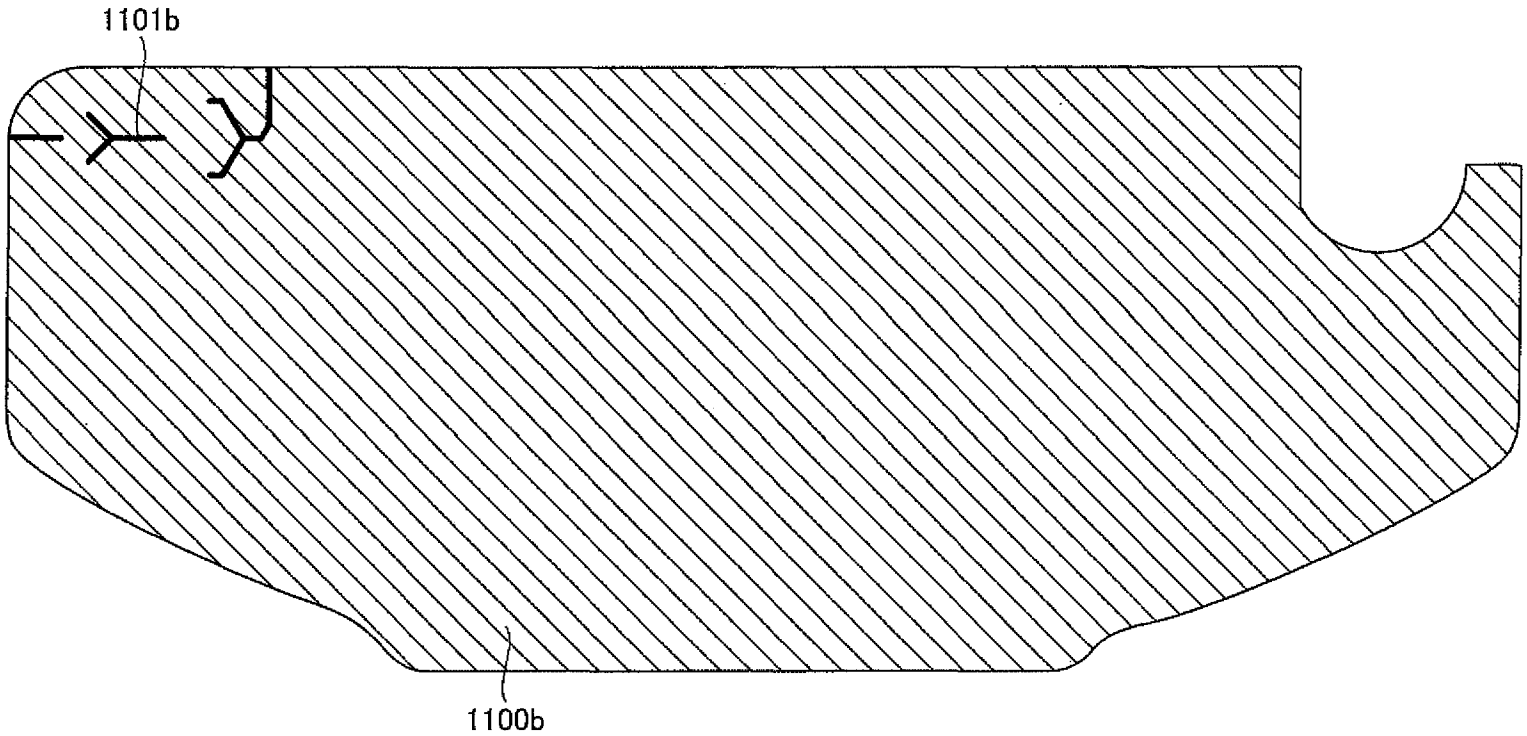
FIG. 12 is a top view showing a sealing layer used in the liquid reagent containing microchip according to the fourth embodiment.

The present embodiment also relates to the liquid reagent containing microchip (A). FIG. 11 is a top view of a liquid reagent containing microchip 1100 according to the present embodiment as viewed from the first substrate side (the sealing layer 1100*b* side). FIG. 12 is a top view showing a sealing layer 1100*b* used in the liquid reagent containing microchip 1100 shown in FIG. 11. The liquid reagent containing microchip 1100 is characterized by using the sealing layer 1100*b* having an L-shaped cut 1101*b* at a corner portion at the upper portion thereof as shown in FIG. 12. The microchip body is the same as the microchip body 600*a* of the second embodiment.

Figure 13:
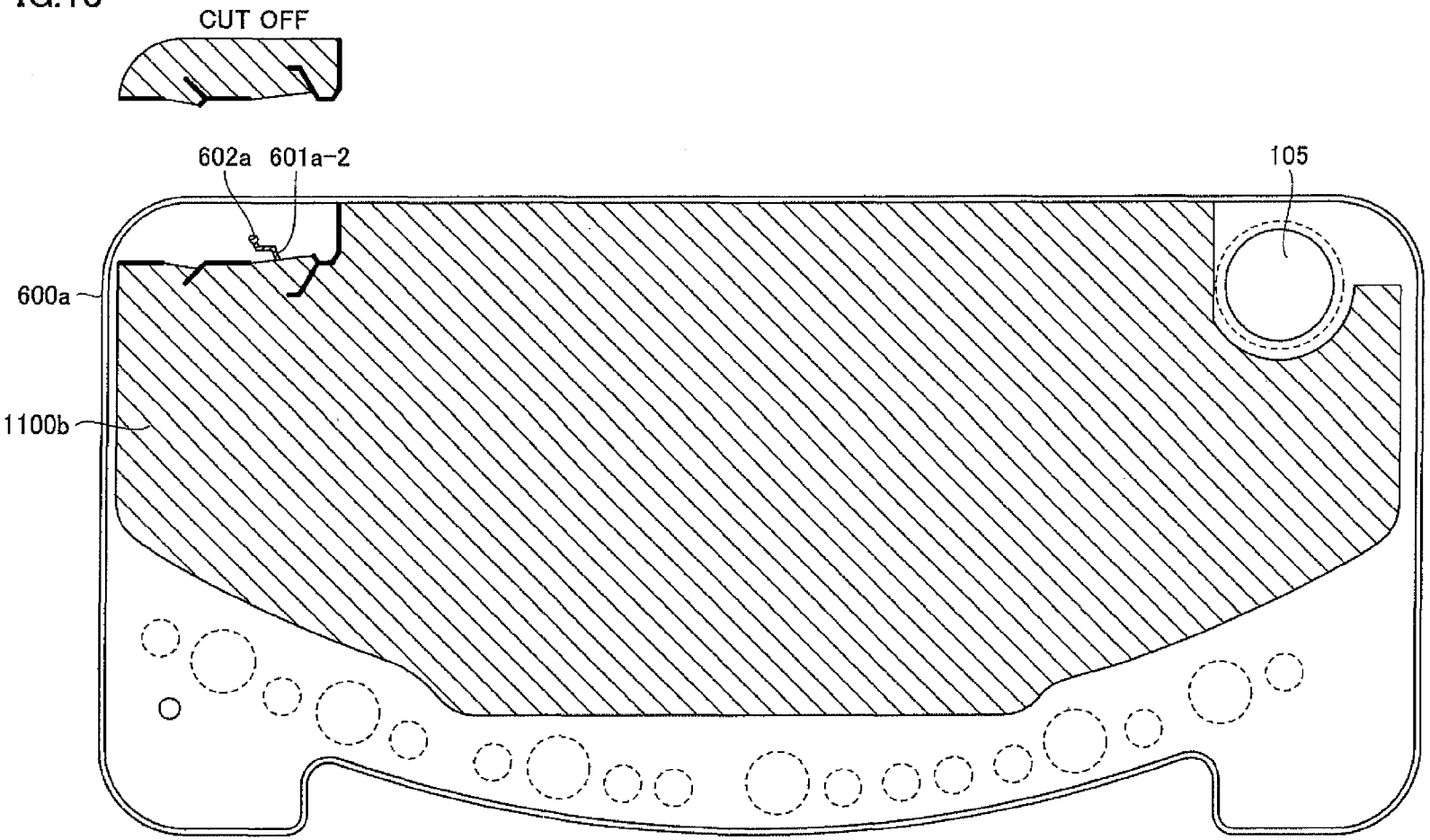
FIG. 13 is a top view showing the liquid reagent containing microchip according to the fourth embodiment with a corner portion of the sealing layer cut off along a cut.

In the microchip body 600*a*, the second path of the air introduction path has only one end portion (and an air introduction concave portion) arranged in the vicinity of the corner at the upper portion of the microchip body 600*a*. Therefore, when the sealing layer 1100*b* having the cut 1101*b* to allow the corner portion of the sealing layer to be easily detached (cut off) is employed, as shown in FIG. 13, the sealing layer at a portion stacked on the end portion (and the air introduction concave portion) of the second path of the air introduction path can be easily stripped off, and the second path (and the air introduction concave portion) can be opened to the outside of the microchip. Therefore, the operation of stripping off the sealing layer can be simpler.

Fifth Embodiment

The present embodiment relates to the packaged liquid reagent containing microchip (B) including a package and the liquid reagent containing microchip (A) accommodated in the package. In general, the liquid reagent containing microchip is hermetically accommodated in the package for distribution, sale, and storage in order to prevent degradation of the liquid reagent contained in the reagent retaining portions. The liquid reagent containing microchip according to the foregoing first to fourth embodiments includes a sealing layer stacked on the first substrate as a sealing portion for sealing the air introduction path and the air introduction concave portion immediately before use of the microchip. During use of the microchip, the sealing layer is partially striped off. Considering that the liquid reagent containing microchip is generally accommodated in a package, the packaged liquid reagent containing microchip of the present embodiment takes an advantage of this point and further improves the simplicity of the operation of sealing off the sealing layer.

Figure 14:
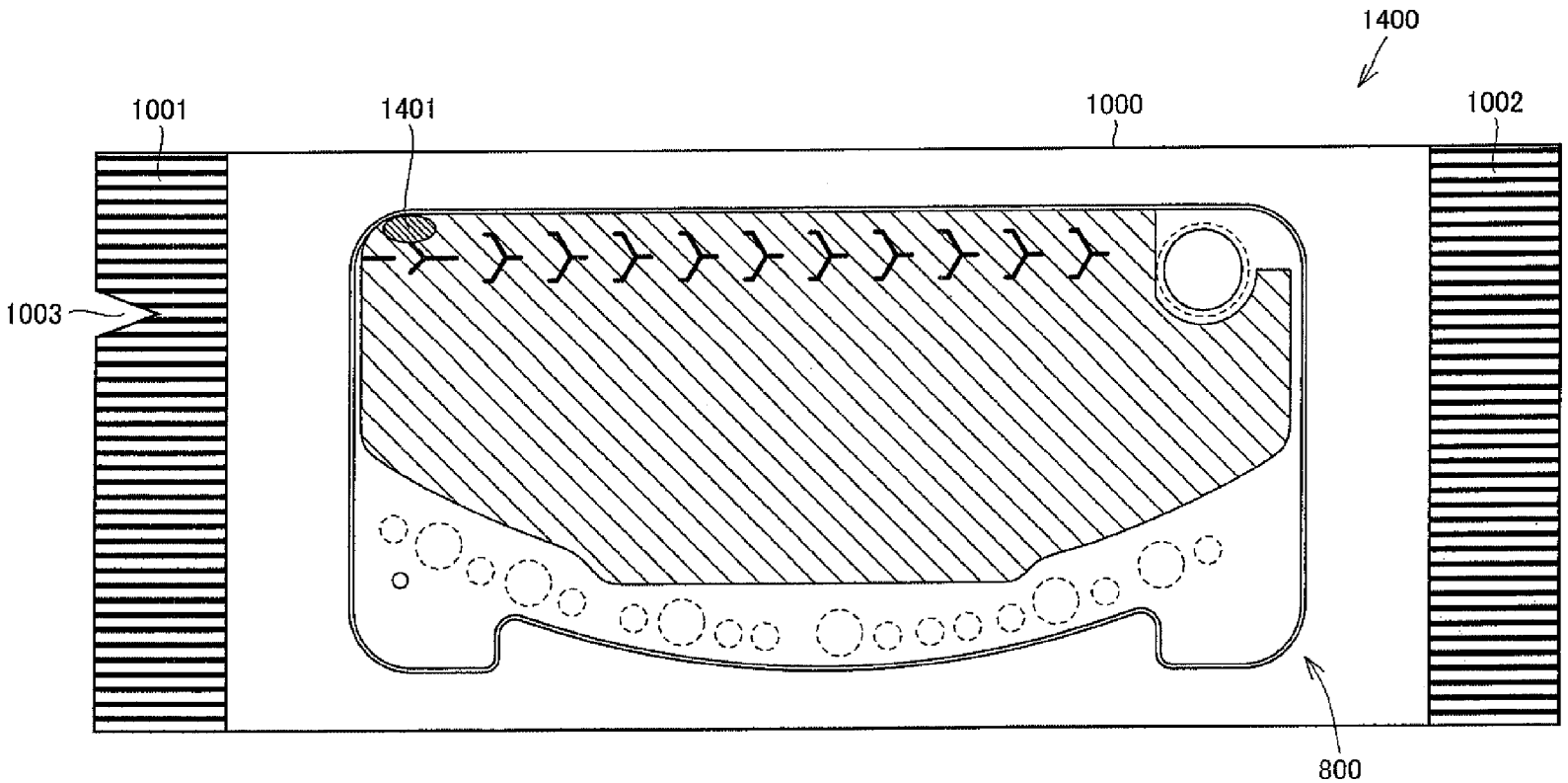
FIG. 14 is a top view showing an example of a packaged liquid reagent containing microchip according to a fifth embodiment.

FIG. 14 is a top view showing an example of the packaged liquid reagent containing microchip. A packaged liquid reagent containing microchip 1400 shown in FIG. 14 is obtained by putting the liquid reagent containing microchip 800 according to the third embodiment into a bag-like package 1000 and closing the opening of the package 1000 by heat seal (heat seal portions 1001 and 1002) to hermetically seal the microchip. The liquid reagent containing microchip 800 according to the third embodiment employs the sealing layer 800*b* having the cut 801*b* to allow the upper portion of the sealing layer (the portion stacked on the end portions of all the first paths and all the air introduction concave portions) to be easily cut off as described above. Then, the upper portion of the sealing layer to be cut off and the package are joined together using an adhesive 1401.

With the packaged liquid reagent containing microchip 1400 as described above, when the package 1000 is opened starting from an opening cut 1003 of the package 1000, the upper portion of the sealing layer is simultaneously cut off. Thus, removal of the microchip from the package and the operation of stripping off the sealing layer are simultaneously carried out, thereby eliminating the need for separately performing the operation of stripping off the sealing layer.

The adhesive 1401 is preferably arranged at an end portion of the upper portion of the sealing layer or in the vicinity thereof. In this case, the liquid reagent containing microchip 800 is preferably accommodated in the package 1000 such that the adhesive 1401 is arranged on the side of the opening cut 1003 of the package 1000.

The liquid reagent containing microchip accommodated in the package 1000 is not limited to the liquid reagent containing microchip 800 according to the third embodiment and may be, for example, the liquid reagent containing microchip 1100 according to the fourth embodiment. In this case, the portion of the sealing layer (the portion to be cut off) that is stacked on the end portion of the second path of the air introduction path is joined with the package 1000.

Figure 15:
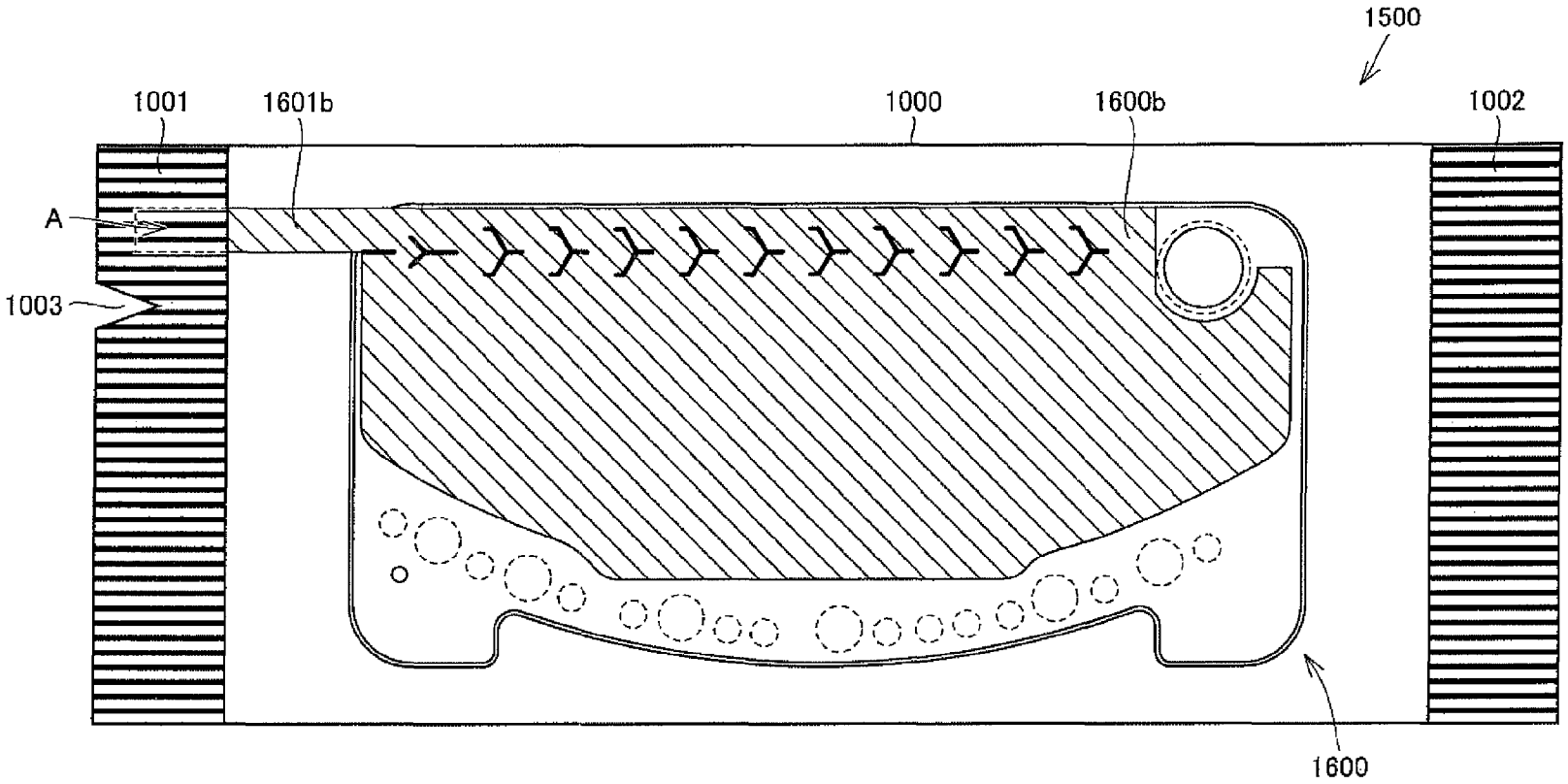
FIG. 15 is a top view showing another example of the packaged liquid reagent containing microchip according to the fifth embodiment.
Figure 16:
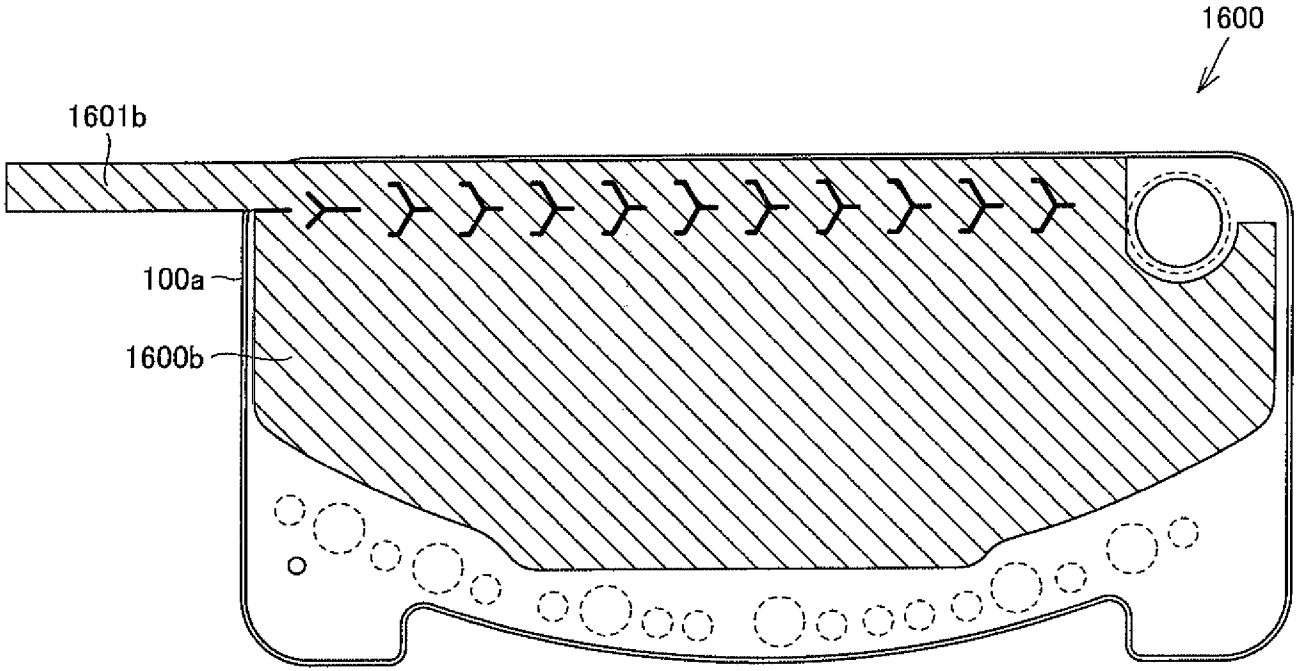
FIG. 16 is a top view showing a liquid reagent containing microchip used in the packaged liquid reagent containing microchip shown in FIG. 15.

The method of joining the sealing layer and the package is not limited to the method using adhesive. For example, as in a packaged liquid reagent containing microchip 1500 shown in FIG. 15, a liquid reagent containing microchip 1600 (see FIG. 16) may be used, in which a sealing layer 1600*b* having an extension portion 1601*b* at the upper portion of the sealing layer (the portion to be cut off) is stacked. The extension portion 1601*b* of the sealing layer 1600*b* is joined with the package 1000, so that when the package 1000 is opened starting from the opening cut 1003 of the package 1000, the upper portion of the sealing layer 1600*b* (and the extension portion 1601*b*) is simultaneously cut off. The extension portion 1601*b* and the package 1000 can be joined by heat-sealing the end portion A of the extension portion 1601*b* sandwiched when the opening of the package 1000 is closed.

Figure 17:
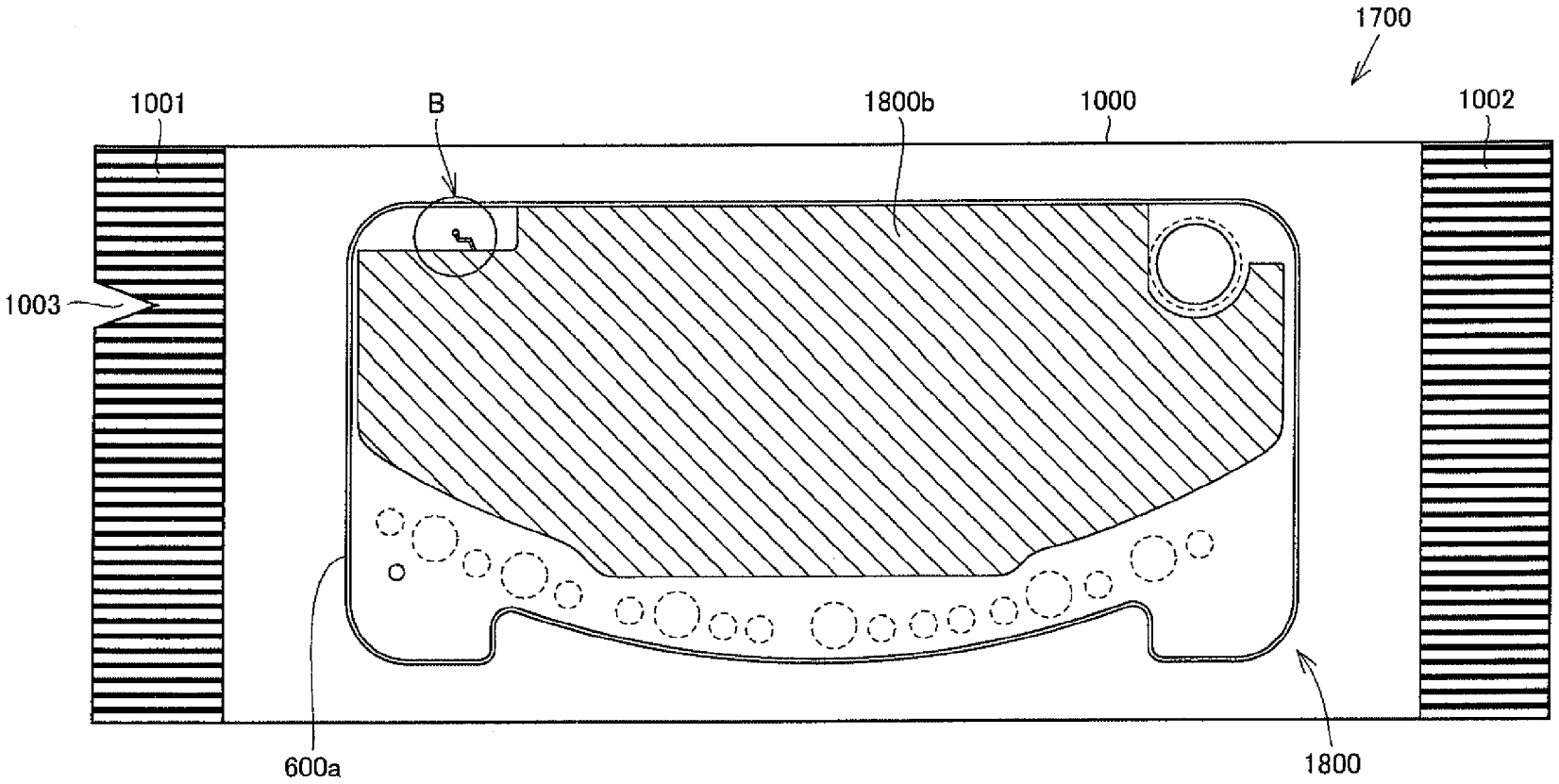
FIG. 17 is a top view showing another example of the packaged liquid reagent containing microchip according to the fifth embodiment.

FIG. 17 is a top view showing another example of the packaged liquid reagent containing microchip. The packaged liquid reagent containing microchip 1700 shown in FIG. 17 is obtained by putting a liquid reagent containing microchip 1800 into the bag-like package 1000 and closing the opening of the package 1000 by heat seal (heat seal portions 1001 and 1002) to hermetically accommodate the microchip. The liquid reagent containing microchip 1800 is characterized by using a sealing layer 1800*b* having a notch portion at a corner at the upper portion thereof. The microchip body is the same as the microchip body 600*a* of the second embodiment. The notch portion corresponds to a portion to be cut off that is defined by the cut 1101*b* of the sealing layer 1100*b* according to the fourth embodiment. That is, the sealing layer 1800*b* corresponds to the sealing layer 1100*b* from which the portion to be cut off is cut off in advance.

In this example, a region (for example, a region B shown in the drawing) exposed at the notch portion and including the end portion of the second path of the air introduction path and the air introduction concave portion is directly joined with the package 1000, so that the end portion of the second path of the air introduction path and the air introduction concave portion are sealed. In this manner, in this example, part of the sealing layer as a sealing portion is formed of part of the package 1000. The microchip body 600*a* (the region described above) and the package 1000 are joined together, for example, by heat seal.

The packaged liquid reagent containing microchip 1700 in this example also eliminates the need for separately performing the operation of stripping off the sealing layer because when the package 1000 is opened starting from the opening cut 1003 of the package 1000, the region including the end portion of the second path of the air introduction path and the air introduction concave portion can be simultaneously opened to the outside of the microchip.

The liquid reagent containing microchip 1800 is preferably accommodated in the package 1000 such that the notch portion of the sealing layer 1800*b* is arranged on the side of the opening cut 1003 of the package 1000.

Sixth Embodiment

Figure 18:
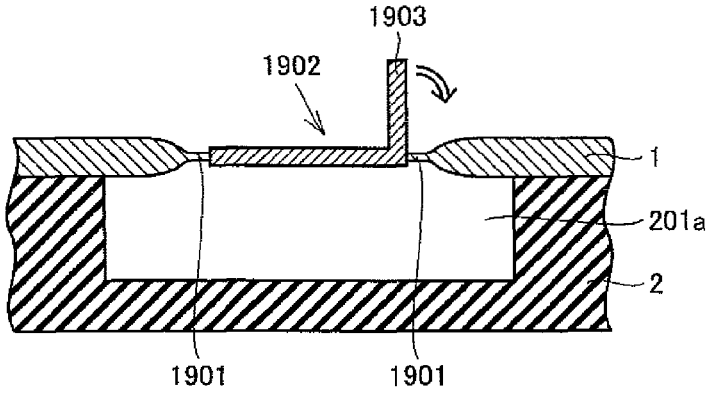
FIG. 18 is a schematic sectional view showing an example of a liquid reagent containing microchip according to a sixth embodiment.

The present embodiment relates to the liquid reagent containing microchip (A). FIG. 18 is a schematic sectional view showing an example of a liquid reagent containing microchip according to the present embodiment and showing the enlarged view of the periphery of the reagent retaining portion 201*a*. In the foregoing first to fourth embodiments, the sealing layer stacked on the outer surface of the first substrate so as to cover the air introduction path (and the air introduction concave portion) is used as a sealing portion for sealing the air introduction path (and the air introduction concave portion). However, the sealing portion is not limited thereto, and the sealing portion as in the present embodiment may be used.

Figure 19:
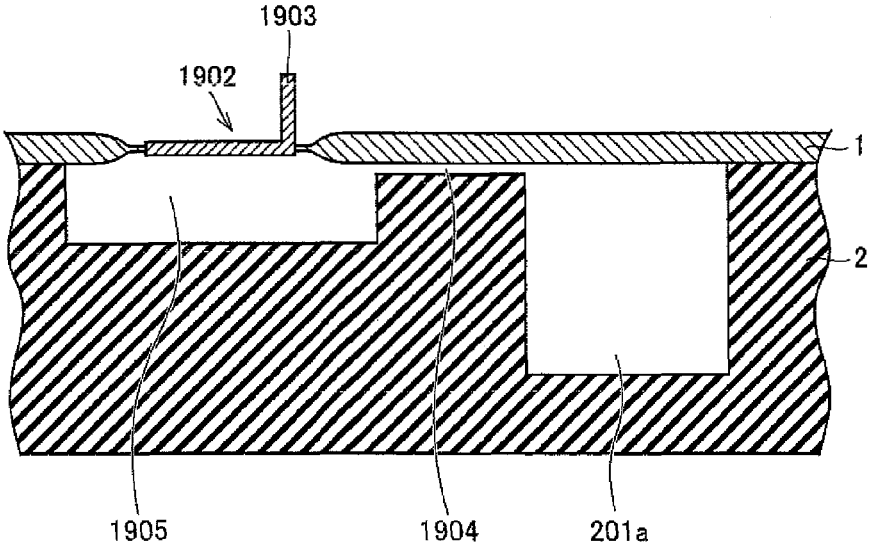
FIG. 19 is a schematic sectional view showing another example of the liquid reagent containing microchip according to the sixth embodiment.

The liquid reagent containing microchip according to the present embodiment has a sealing portion 1902 provided on the reagent retaining portion 201*a*. The sealing portion 1902 is integrally formed with the first substrate 1 and is coupled to the first substrate 1 by means of a thin portion 1901. During use of the microchip, a pawl 1903 of the sealing portion 1902 is tilted in the direction of the arrow shown in the drawing to cut off the thin portion 1901. Then, the sealing portion 1902 is detached to form an opening above the reagent retaining portion 201*a*. Accordingly, the air is supplied from the opening with discharge of the liquid reagent from the reagent discharge path, so that the liquid reagent can be discharged well from the reagent retaining portion. The sealing portion 1902 functioning as a temporary cover to the opening may be provided on the waste storage portion 1905 connected to the reagent retaining portion 201*a* through a flow path 1904, as shown in FIG. 19, or on a part other than the waste storage portion and the reagent retaining portion.

Seventh Embodiment

The present embodiment relates to the liquid reagent containing microchip (C). An example of the liquid reagent containing microchip according to the present embodiment and the substrates that constitute the same is shown in FIG. 20 to FIG. 27. A liquid reagent containing microchip 2000 shown in those drawings is formed by stacking a first substrate 4 that is a transparent substrate, a second substrate 5 that is a black substrate having grooves on both surfaces for forming a fluid circuit, and a third substrate 6 that is a transparent substrate, in this order, and laminating those substrates together.

Figure 20:
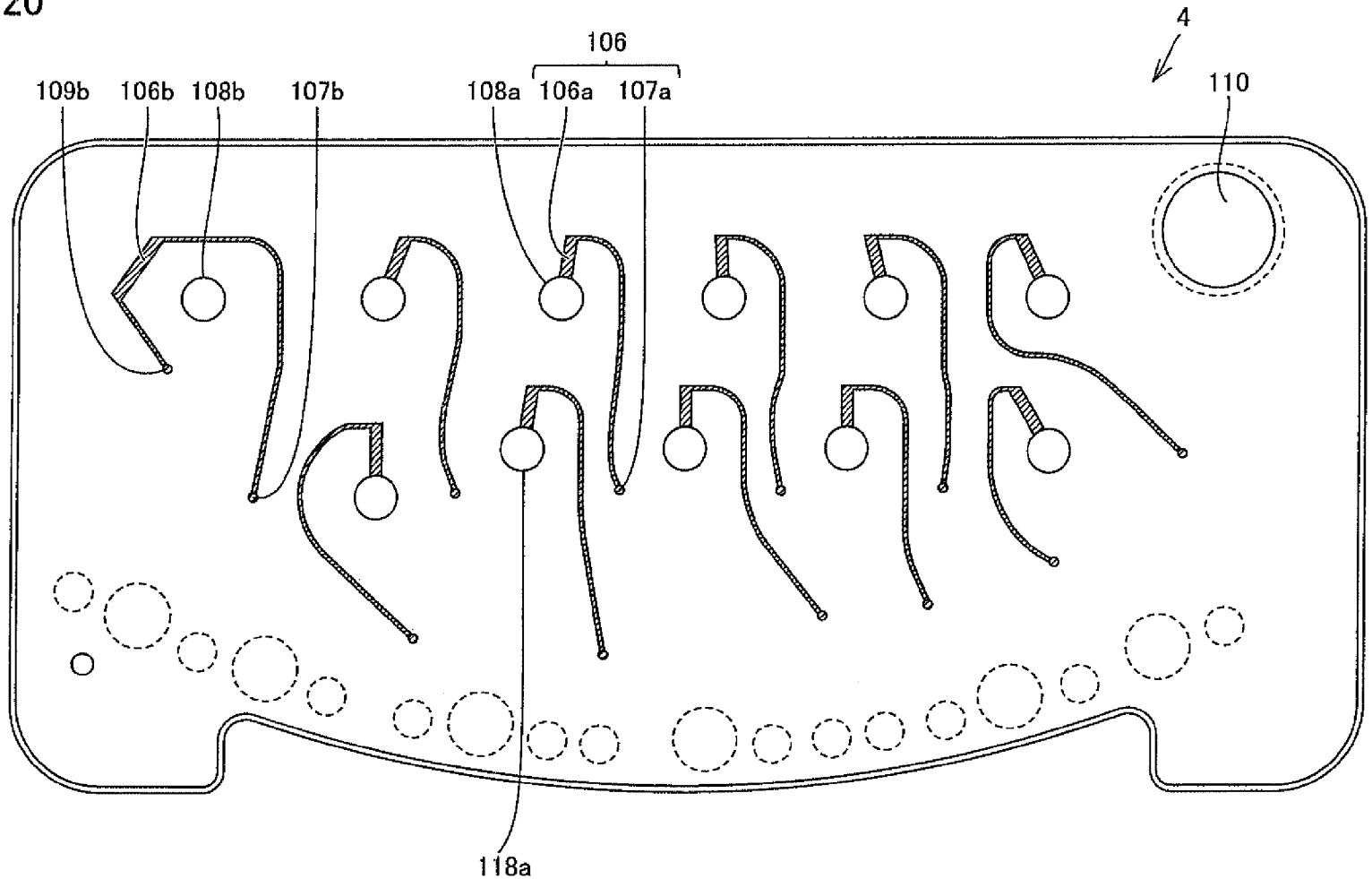
FIG. 20 is a top view showing an outer surface of a first substrate that constitutes a liquid reagent containing microchip according to a seventh embodiment.
Figure 21:
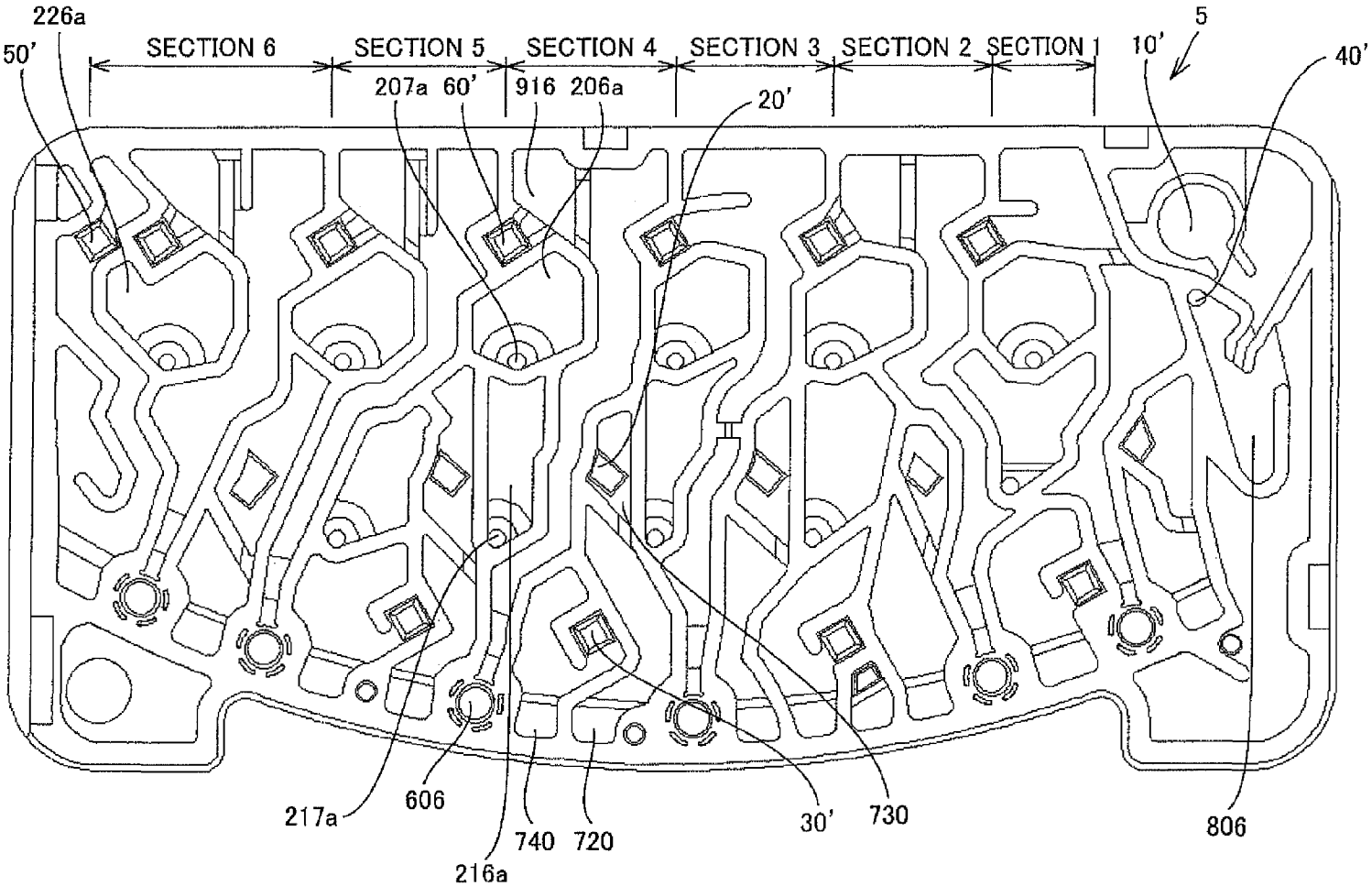
FIG. 21 is a top view showing a surface on the first substrate side of a second substrate that constitutes the liquid reagent containing microchip according to the seventh embodiment.
Figure 22:
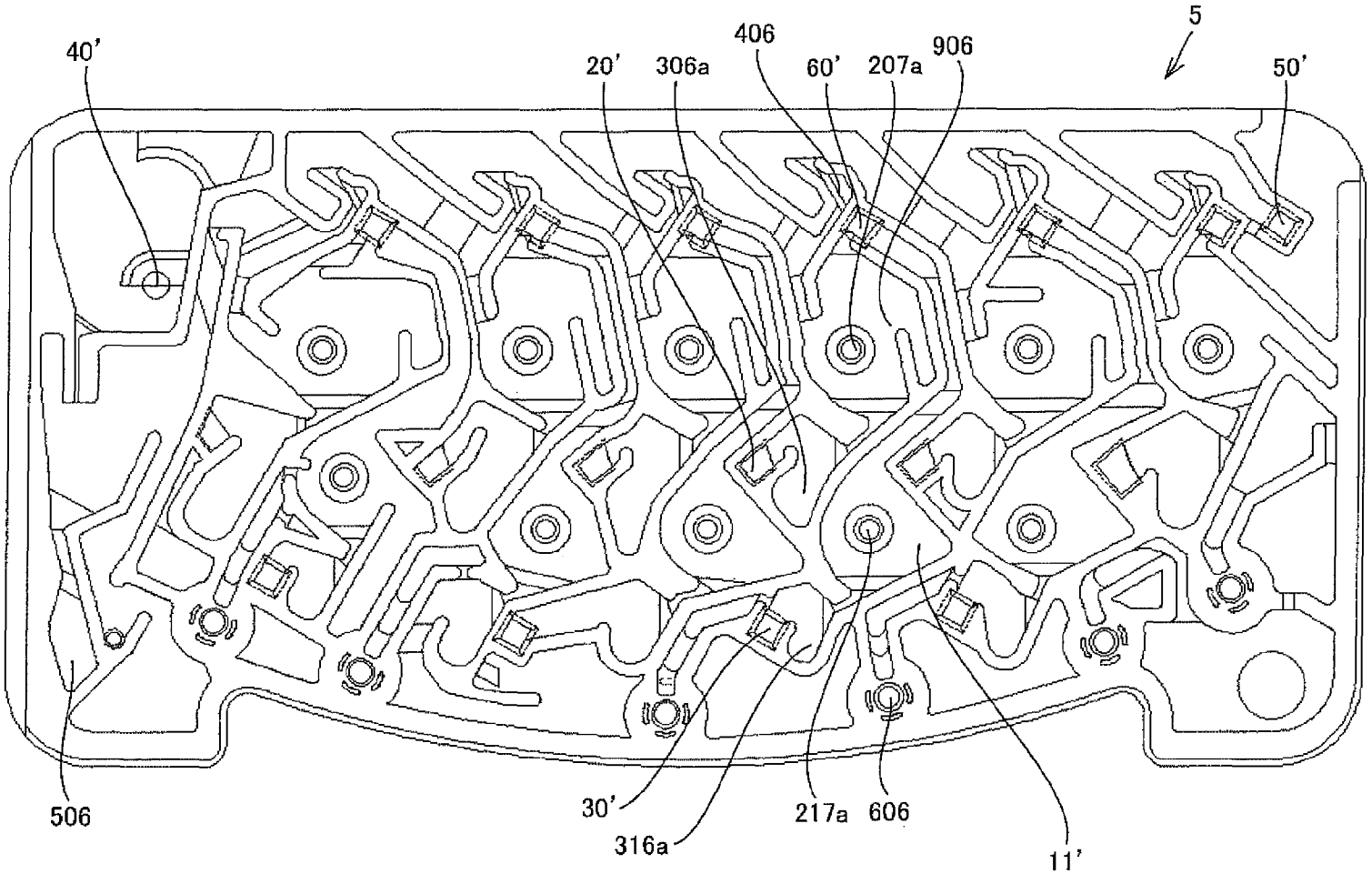
FIG. 22 is a top view showing a surface on the third substrate side of the second substrate that constitutes the liquid reagent containing microchip according to the seventh embodiment.
Figure 23:
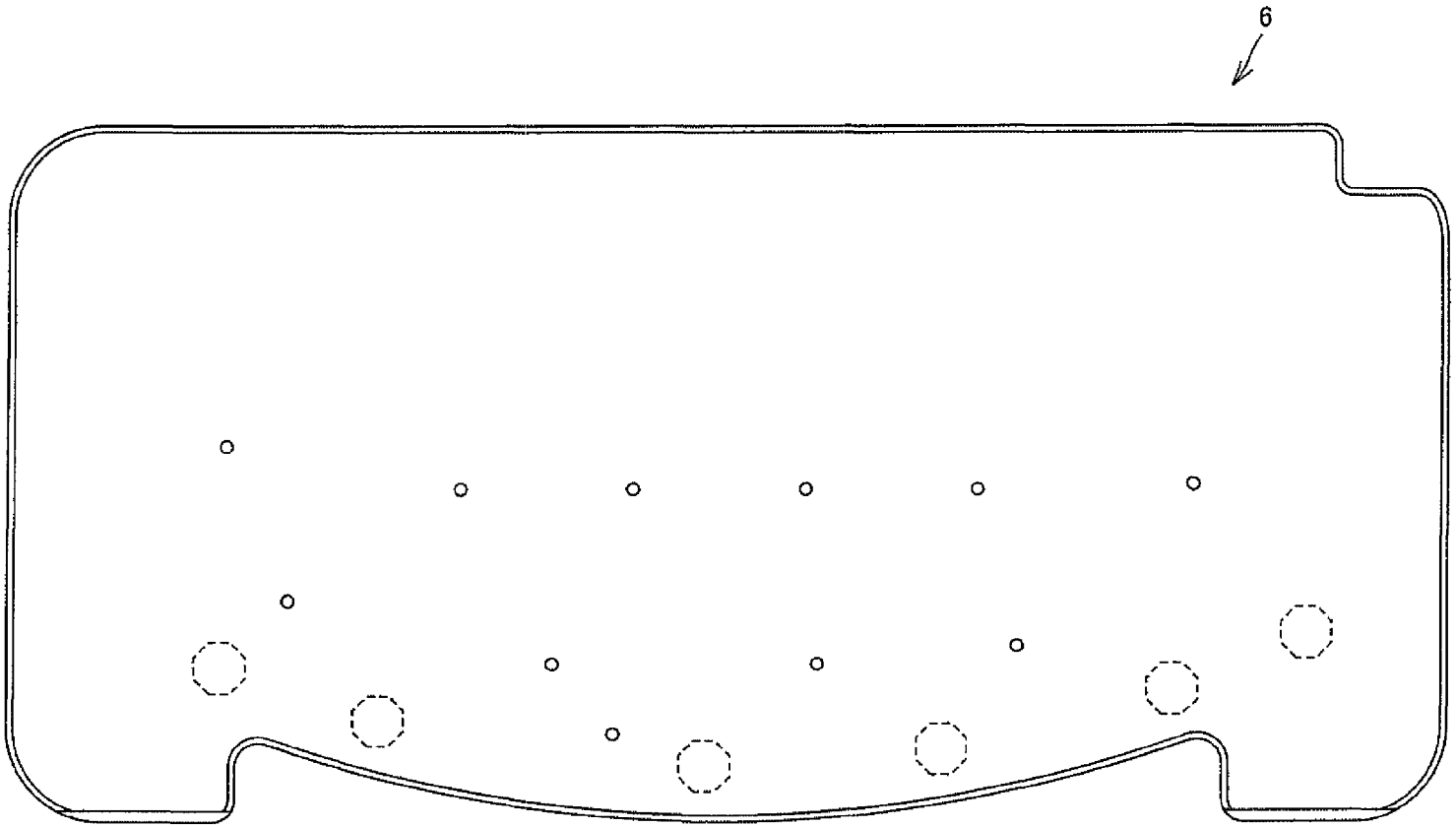
FIG. 23 is a top view showing an outer surface of a third substrate that constitutes the liquid reagent containing microchip according to the seventh embodiment.
Figure 24:
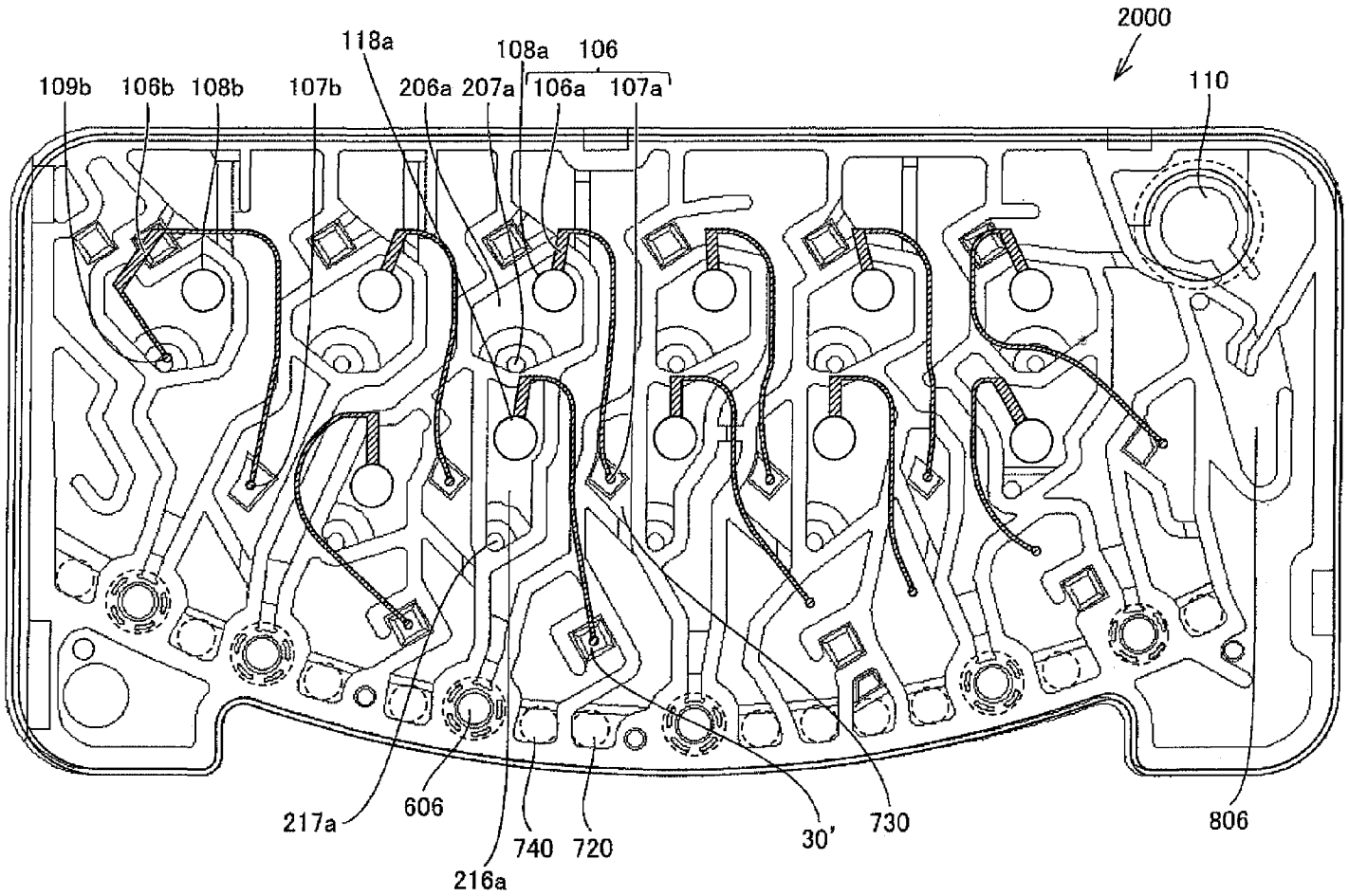
FIG. 24 is a top view of the liquid reagent containing microchip according to the seventh embodiment.
Figure 25:
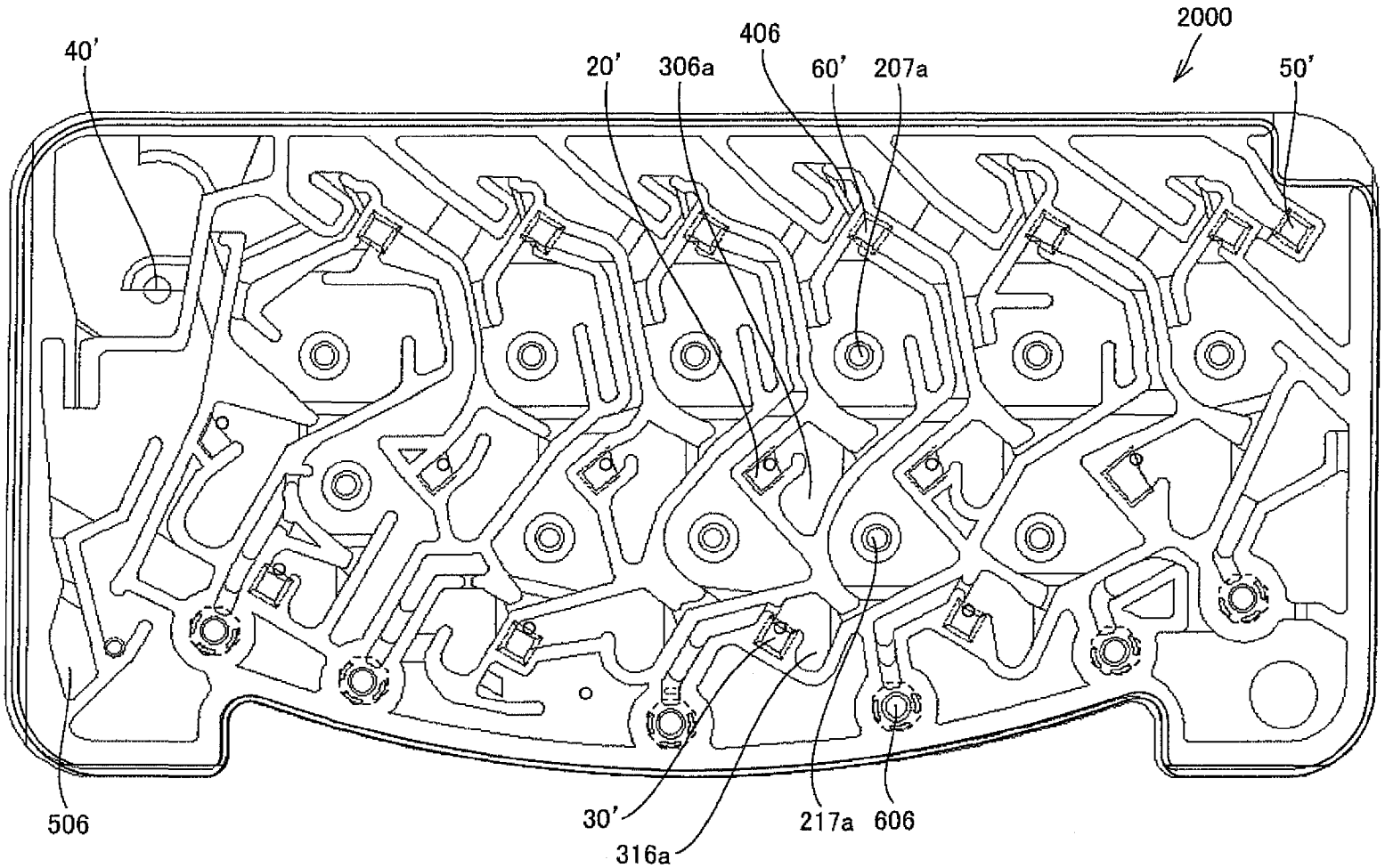
FIG. 25 is a bottom view of the liquid reagent containing microchip according to the seventh embodiment.
Figure 26:
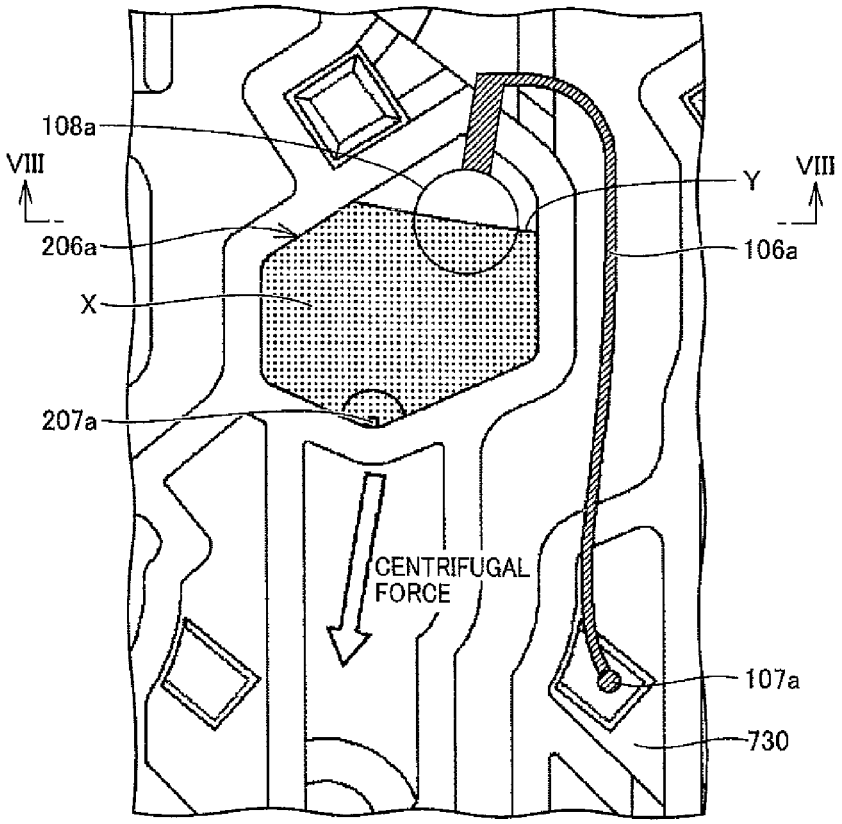
FIG. 26 is a partially enlarged top view of FIG. 24.
Figure 27:
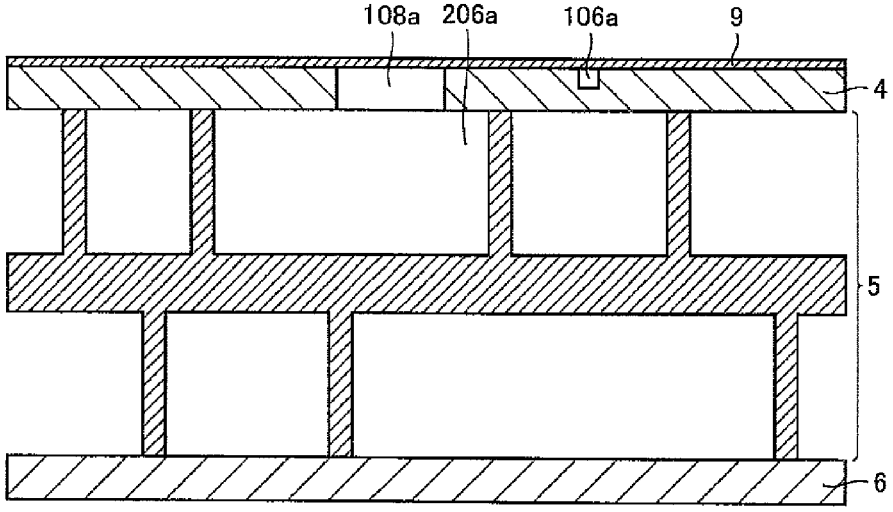
FIG. 27 is a sectional view along a line VIII-VIII shown in FIG. 26.

FIG. 20 is a top view showing an outer surface (the surface opposite to the second substrate 5 side) of the first substrate 4. FIG. 21 is a top view showing a surface on the first substrate 4 side of the second substrate 5, and FIG. 22 is a top view showing a surface on the third substrate 6 side of the second substrate 5. FIG. 23 is a top view showing an outer surface (the surface opposite to the second substrate 5 side) of the third substrate 6. FIG. 24 is a top view of the liquid reagent containing microchip 2000 formed by laminating the first to third substrates together, in which grooves, through holes, etc. (those shown in FIG. 20) provided on the outer surface of the first substrate 4 and grooves, etc. (those shown in FIG. 21) provided on the surface on the first substrate 4 side of the second substrate 5 are displayed in an overlaid state. FIG. 25 is a bottom view of the liquid reagent containing microchip 2000 formed by laminating the first to third substrates together, in which through hole, etc. (those shown in FIG. 23) provided on the outer surface of the third substrate 6 and grooves, etc. (those shown in FIG. 22) provided on the surface on the third substrate 6 side of the second substrate 5 are displayed in an overlaid state. FIG. 26 is a partially enlarged top view of FIG. 24, and FIG. 27 is a sectional view along a line VIII-VIII shown in FIG. 26.

A dotted line in FIGS. 20, 22, 24, and 25 means that a region encircled by the dotted line forms a concave portion.

Referring to FIG. 20 and FIG. 24, in total, eleven reagent inlets including reagent inlets 108*a*, 108*b*, and 118*a* are provided in the first substrate 4. These reagent inlets are through holes passing through the first substrate 4 in the thickness direction. In the first substrate 4, a sample introduction port 110 is also provided, which is also a through hole passing through the first substrate 4 in the thickness direction for introducing a sample (for example, whole blood) into the fluid circuit. The liquid reagent containing microchip 2000 is subjected to use (test and analysis of a sample) in such a manner that a sealing layer 9 such as a sealing label (seal) having a size that can seal all the reagent inlets as well as all the grooves and all the through holes that constitute the air introduction paths as described later is affixed to the outer surface of the first substrate 4 to seal the first substrate 4 after liquid reagent is poured from the reagent inlets (see FIG. 27.) It is noted that in FIG. 20 to FIG. 26, the sealing layer 9 is omitted in order to facilitate clear understanding of the structure of the microchip surface and the structure of the fluid circuit.

The fluid circuit of the liquid reagent containing microchip 2000 will be described. Referring to FIG. 21 and FIG. 22, the second substrate 5 has grooves formed on both surfaces thereof and a plurality of through holes passing through the thickness direction. The first substrate 4 and the third substrate 6 are laminated with the second substrate 5, whereby a two-layer fluid circuit is formed inside the microchip. In the following, a fluid circuit configured with the surface on the second substrate 5 side of the first substrate 4 and the groove provided on the surface on the first substrate 4 side of the second substrate 5 is referred to as a "first fluid circuit," and a fluid circuit configured with the surface on the second substrate 5 side on the third substrate 6 and the groove provided on the third substrate 6 side of the second substrate 5 is referred to as a "second fluid circuit." These two fluid circuits are coupled with each other through several through holes formed in the second substrate 5 and passing through the thickness direction.

The structure of the first fluid circuit can be understood from FIG. 21, and the structure of the second fluid circuit can be understood from FIG. 22. The liquid reagent containing microchip 2000 is a multi-item chip that allows tests or analyses for six items for one sample, and the fluid circuit thereof is divided into six sections [sections 1 to 6 in FIG. 21 (the first fluid circuit), which is applicable to FIG. 22 (the second fluid circuit)] to allow tests or analyses for six items. It is noted that these sections are connected with each other in a sample measuring portion installation region (the upper region of the second fluid circuit shown in FIG. 22).

The sections described above have almost the same configuration, and the fluid treatments therein are also similar. Therefore, "section 4" is mainly described below as an example.

In section 4, two reagent retaining portions containing a liquid reagent are provided in the first fluid circuit (reagent retaining portions 206*a* and 216*a* in FIG. 21 and FIG. 24). As described above, a reagent inlet that is a through hole passing through the first substrate 4 in the thickness direction is provided (the reagent inlets 108*a* and 118*a* in FIG. 20 and FIG. 24) in each reagent retaining portion. Reagent discharge paths 207*a* and 217*a* for discharging the liquid reagent in the reagent retaining portions are coupled to the lower ends of the respective reagent retaining portions (see FIG. 21 and FIG. 24). The reagent discharge paths 207*a* and 217*a* are through holes extending in the thickness direction of the second substrate 5 and connect to the second fluid circuit on the back side. The liquid reagent discharged from the reagent retaining portions 206*a* and 216*a* is introduced to reagent measuring portions 306*a* and 316*a*, respectively, in the second fluid circuit and is measured (see FIG. 22 and FIG. 25).

In section 4, a sample measuring portion 406 for measuring a specific component in the sample is provided in the second fluid circuit. Such a sample measuring portion is provided for each section. The sample measuring portions are connected in series through flow paths (see FIG. 22 and FIG. 25).

The liquid reagent containing microchip 2000 further includes a separation portion 506 for removing a specific component (a component to be mixed with the liquid reagent) from the sample introduced into the microchip (for example, for separating a blood cell component from whole blood and removing a plasma component) (see FIG. 22 and FIG. 25). The separation operation is performed by centrifugal separation.

The sample introduced from the sample introduction port 110 has a specific component removed by the separation portion 506 and is thereafter distributed to each section and measured by the sample measuring portion (for example, the sample measuring portion 406 in section 4). Then, the sample is mixed with one or two kinds of liquid reagent separately measured in each section and is introduced to each detection portion (for example, a detection portion 606 in section 4) (see FIG. 21 and FIG. 22). The liquid mixture introduced to the detection portion is subjected to, for example, optical measurement of applying detection light to the detection portion from the direction approximately vertical to the microchip surface and measuring the transmission ratio of the transmitted light. Thus, for example, a specific component in the liquid mixture is detected.

In the microchip formed of three substrates having the fluid circuit as described above, the liquid reagent containing microchip 2000 of the present embodiment is characterized in that, aside from the reagent discharge path coupled to each reagent retaining portion, an air introduction path for introducing air to the reagent retaining portion is coupled to each reagent retaining portion. In other words, speaking of the reagent retaining portion 206*a* in section 4, referring to FIG. 20, FIG. 24, FIG. 26, which is an enlarged view of the periphery of the reagent retaining portion 206*a* in section 4 in FIG. 24, and FIG. 27, which is a sectional view along a line VIII-VIII shown in FIG. 26, an air introduction path 106 configured with a groove 106*a* extending in a curved manner from a reagent inlet 108*a* and a through hole 107*a* connected to the terminal end of the groove 106*a* is coupled to the reagent retaining portion 206*a*. The air introduction path 106 is coupled to the reagent retaining portion 206*a* through the reagent inlet 108*a*. This is applicable to the reagent retaining portion 216*a* in section 4 and the reagent retaining portions in the other sections (exceptions will be described later).

The groove 106*a* that constitutes the air introduction path 106 is a groove formed on the outer surface (the surface opposite to the second substrate 5 side) of the first substrate 4. The through hole 107*a* is a through hole passing through the first substrate 4 in the thickness direction. The through hole 107*a* is located immediately above a flow path 730 connected to a waste storage portion 720. The sectional shapes of the groove 106*a* and the through hole 107*a* are not specifically limited and may be rectangular, square, circular or the like. Here, the through hole 107*a* is spatially in communication with the flow path 730. Therefore, the terminal end of the through hole 107*a* is in communication with the outside of the microchip because the flow path 730 is connected to the sample introduction port 110 through other flow paths and parts (chambers) that constitute the first and second fluid circuits.

In the liquid reagent containing microchip 2000 which includes the air introduction path as described above, aside from the reagent discharge path coupled to the reagent retaining portion, even when the sectional area of the reagent discharge path is reduced enough to prevent unintended leakage of liquid reagent from the reagent discharge path after manufacture and before use of the microchip (for example, during storage or transport), when centrifugal force in a prescribed direction for discharging the liquid reagent from the reagent discharge path is applied, air is supplied from the air introduction path with discharge of liquid reagent, and therefore, internal pressure reduction does not occur. Thus, the liquid reagent can be discharged well (smoothly).

In order to prevent unintended leakage of liquid reagent from the reagent discharge path after manufacture and before use of the microchip, the sectional area of the reagent discharge path is preferably 100 to 500,000 $\mu m^2$, more preferably 100 to 10,000 $\mu m^2$.

The coupling portion between the reagent retaining portion and the air introduction path (as for the reagent retaining portion 206*a* in section 4, the coupling portion between the reagent inlet 108*a* and the air introduction path 106 (more specifically, the groove 106*a*)) can be set at any position in the reagent retaining portion relatively flexibly as shown by other embodiments as described later. In the present embodiment, referring to FIG. 26, the coupling portion between the reagent retaining portion 206*a* and the air introduction path 106 is provided on the side opposite to the coupling portion between the reagent retaining portion 206*a* and the reagent discharge path 207*a*, with respect to a fluid level Y formed by the entire amount of liquid reagent X in the reagent retaining portion 206*a* when centrifugal force in a prescribed direction for discharging liquid reagent X from the reagent discharge path 207*a* (centrifugal force in the approximately downward direction in FIG. 26, such as the direction of the arrow shown in FIG. 26) is applied. In other words, the coupling portion between the reagent retaining portion 206*a* and the air introduction path 106 is provided at such a position in that the coupling portion does not come into contact with liquid reagent X when centrifugal force in a prescribed direction for discharging liquid reagent X from the reagent discharge path 207*a* is applied.

When the coupling portion between the reagent retaining portion and the air introduction path is provided at such a location, the liquid reagent in the reagent retaining portion can be prevented from flowing through the air introduction path to the entrance side of the air introduction path (the terminal end side of the through hole that constitutes the air introduction path) due to siphonage during application of centrifugal force for discharging the liquid reagent from the reagent discharge path.

In the reagent retaining portion 206*a* in section 4, the air introduction path 106 (groove 106*a*) is coupled to the reagent inlet 108*a*. However, the present invention is not limited thereto. For example, as in a reagent retaining portion 226*a* in section 6, aside from the reagent inlet 108*b*, a through hole 109*b* passing through the first substrate 4 in the thickness direction may be provided at any given position immediately above the reagent retaining portion 226*a* to form an air introduction path. Specifically, in the reagent retaining portion 226*a* in section 6, the air introduction path is formed with the through hole 109*b*, the groove 106*b* connected to the through hole 109*b* and formed on the outer surface of the first substrate 4, and a through hole 107*b* connected to the groove 106*b* (see FIG. 20 and FIG. 24).

In the present embodiment, the position in the fluid circuit where the through hole that constitutes the air introduction path and serves as the terminal end (entrance) of the air introduction path is set is not specifically limited. Referring to FIG. 26, the through hole 107*a* may be provided on the side opposite to the coupling portion between the reagent retaining portion 206*a* and the reagent discharge path 207*a*, or may be provided on the same side, with respect to the fluid level Y formed by the entire amount of liquid reagent X in the reagent retaining portion 206*a* when centrifugal force in a prescribed direction for discharging liquid reagent X from the reagent discharge path 207*a* is applied. In FIG. 26, the through hole 107*a* is provided on the same side.

Considering a bare possibility that the liquid reagent flows into the air introduction path from the coupling portion between the reagent retaining portion and the air introduction path and flows out from the terminal end (entrance) of the air introduction path to leak into the fluid circuit, for example, during shipment and transport of the microchip, the through hole that constitutes the air introduction path is preferably provided immediately above the waste storage portion for accommodating waste liquid or the flow path connected thereto, in the fluid circuit. The through hole 107*a* that constitutes the air introduction path 106 in the reagent retaining portion 206*a* in section 4 is provided immediately above the flow path 730 connected to the waste storage portion 720 for accommodating the liquid reagent overflowing the reagent measuring portion 306*a* during measurement of the liquid reagent. Considering the bare possibility described above, a part (chamber) for accommodating the liquid reagent flowing out from the terminal end (entrance) of the air introduction path may be provided separately from the waste storage portion for accommodating the waste liquid overflowing the measuring portion, and the through hole that constitutes the air introduction path may be provided immediately above that part or a flow path connected thereto.

Let $\phi_1$ be the sectional area of the terminal end of the reagent discharge path and $\phi_2$ be the sectional area of the terminal end of the air introduction path, it is preferable that $\phi_1<\phi_2$ be satisfied. Accordingly, for example, in case that the internal pressure in the reagent retaining portion increases to cause the liquid reagent to flow out from the reagent retaining portion during shipment and transport or storage of the microchip, the liquid reagent flows out from the air introduction path side and does not flow out from the reagent discharge path, thereby giving no adverse effect on test or analysis using the microchip. It is preferable that $\phi_1<\phi_2$ be satisfied also in other embodiments described later.

A test or analysis method (fluid treatment operation) of a sample (whole blood will be taken as an example) by the liquid reagent containing microchip 2000 will be described as follows, mainly taking "section 4" as an example.

(1) Whole Blood Introduction and Liquid Reagent Measuring Process

Whole blood is introduced from the sample introduction port 110 of the first substrate 4. Then, centrifugal force is applied in the approximately downward direction in FIG. 21. Thus, whole blood passes through a region 10' and is introduced to an accommodation portion 806 (see FIG. 21). Furthermore, with the application of centrifugal force in the approximately downward direction, the liquid reagent in the reagent retaining portions 206*a* and 216*a* passes through the reagent discharge paths 207*a* and 217*a*, reaches the reagent measuring portions 306*a* and 316*a*, respectively, and is measured (see FIG. 21 and FIG. 22). The liquid reagent that overflows the reagent measuring portions passes through through holes 20' and 30' and is accommodated in the waste storage portions 720 and 740, respectively (see FIG. 21).

The liquid reagent discharge performance was confirmed using a transparent film as the sealing layer 9 described above and a colored water solution as the liquid reagent. Then, it was confirmed that with application of centrifugal force (3000 rpm, 15 seconds) in the approximately downward direction as described above, the entire amount of the liquid reagent was discharged well from all the reagent retaining portions and introduced into the reagent measuring portions.

(2) Centrifugal Separation Process

Next, after centrifugal force is applied in the approximately leftward direction in FIG. 21, centrifugal force is applied in the approximately downward direction to introduce whole blood in the accommodation portion 806 to the separation portion 506 through a through hole 40'. Then, centrifugal separation is performed in the separation portion 506 by continuously applying the centrifugal force in the approximately downward direction. The whole blood is thus separated into a plasma component (upper layer) and a blood cell component (lower layer).

(3) Sample Measuring Process

Next, centrifugal force in the approximately rightward direction in FIG. 22 is applied. Thus, the plasma component separated in the separation portion 506 is introduced to the sample measuring portion 406 (simultaneously introduced to the other five sample measuring portions) and measured (see FIG. 22). The plasma component overflowing the sample measuring portion moves to the first fluid circuit through a through hole 50' (see FIG. 21 and FIG. 22). This centrifugal force in the approximately rightward direction allows the liquid reagent in the reagent measuring portion 306*a* to move to a mixing portion 906 and allows the liquid reagent in the reagent measuring portion 316*a* to move to a flow path 11'.

(4) First Mixing Process

Next, centrifugal force in the approximately downward direction in FIG. 22 is applied. Thus, the measured liquid reagent (the liquid reagent retained in the reagent retaining portion 206*a*) and the plasma component measured in the sample measuring portion 406 are mixed together in the reagent measuring portion 306*a* (a first step in the first mixing process, see FIG. 22). Next, by applying centrifugal force in the approximately rightward direction in FIG. 22, the liquid mixture is further mixed with the liquid reagent left in the mixing portion 906 (a second step in the first mixing process, see FIG. 22). The first step and the second step are performed multiple times as necessary to ensure mixing.

(5) Second Mixing Process

Next, centrifugal force in the approximately upward direction in FIG. 22 is applied. Thus, the liquid mixture in the mixing portion 906 reaches a mixing portion 916 through a through hole 60', and the other liquid reagent measured (the liquid reagent retained in the reagent retaining portion 216*a*) also reaches the mixing portion 916 through the through hole 60'. Those liquid mixture and liquid reagent are mixed together (a first step in the second mixing process, see FIG. 21 and FIG. 22). Next, centrifugal force in the approximately rightward direction in FIG. 21 is applied to allow the liquid mixture to move inside the mixing portion 916, thereby promoting the mixing (a second step in the second mixing process, see FIG. 21). The first step and the second step are performed multiple times as necessary to ensure mixing.

(6) Detection Portion Introduction Process

Finally, centrifugal force in the approximately downward direction in FIG. 21 is applied. Thus, the liquid mixture in the mixing portion 916 is introduced to the detection portion 606. The liquid mixture charged in the detection portion 606 is subjected to optical measurement for testing or analyzing the sample (the plasma component). For example, a specific component in the liquid mixture is detected by applying light from the direction approximately vertical to the microchip surface and measuring the transmitted light. This is applicable to the liquid mixture introduced to the other detection portions.

Eighth Embodiment

Figure 28:
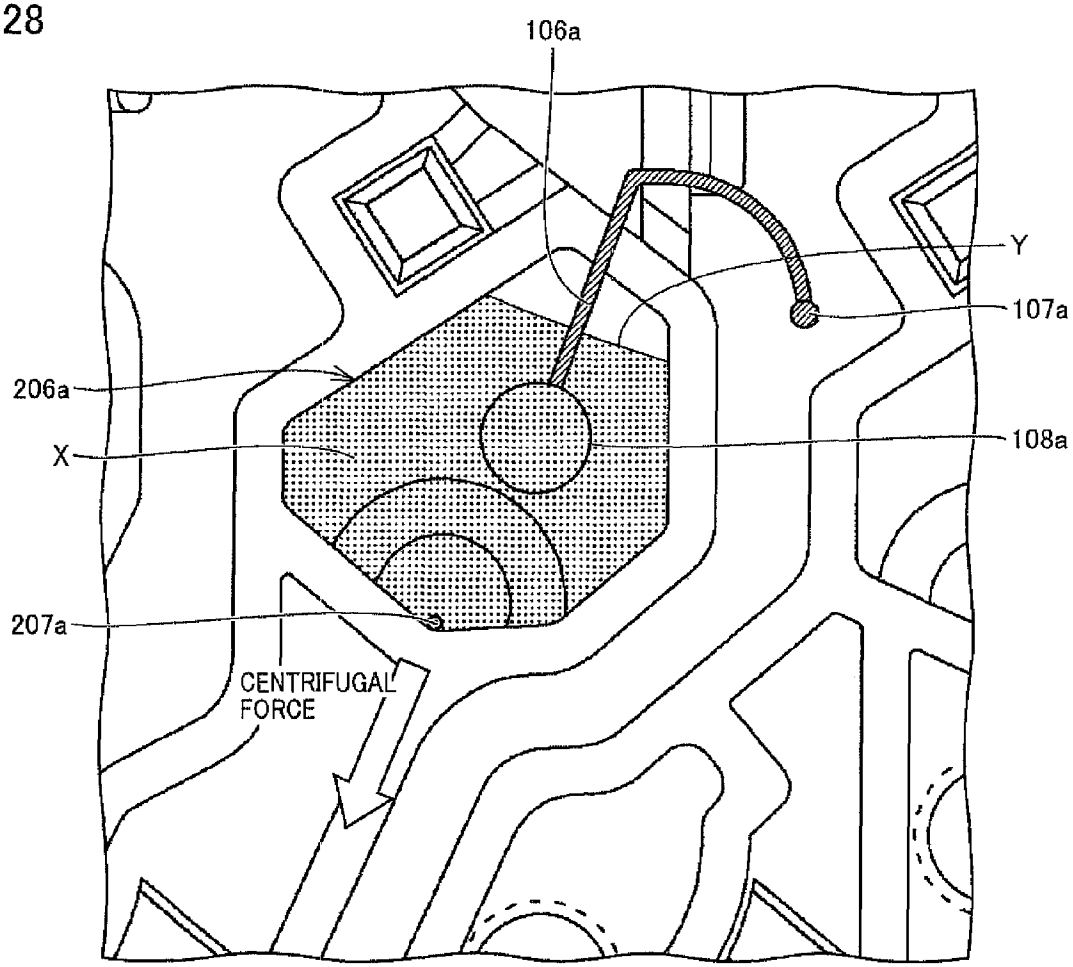
FIG. 28 is a top view showing a partially enlarged view of a liquid reagent containing microchip according to an eighth embodiment.

The present embodiment also relates to the liquid reagent containing microchip (C). FIG. 28 is a top view similar to FIG. 26, showing a partially enlarged view of the liquid reagent containing microchip according to the present embodiment. Also in FIG. 28, the sealing layer 9 is omitted in order to facilitate clear understanding of the structure of the microchip surface and the structure of the fluid circuit.

The present embodiment is characterized as follows. Unlike the air introduction path shown in FIG. 26, the through hole 107*a* that constitutes the air introduction path 106 and serves as the terminal end (entrance) of the air introduction path 106 is provided on the side opposite to the coupling portion between the reagent retaining portion 206*a* and the reagent discharge path 207*a*, with respect to the fluid level Y formed by the entire amount of liquid reagent X in the reagent retaining portion 206*a* when centrifugal force in a prescribed direction for discharging liquid reagent X from the reagent discharge path 207*a* (centrifugal force in the approximately downward direction in FIG. 28, such as the direction of the arrow shown in FIG. 28) is applied.

When the through hole 107*a* (the terminal end of the air introduction path) that constitutes the air introduction path 106 is provided such a position, even when the coupling portion between the reagent retaining portion 206*a* and the air introduction path 106 is not provided on the side opposite to the coupling portion between the reagent retaining portion 206*a* and the reagent discharge path 207*a* with respect to the fluid level Y described above, liquid reagent X in the reagent retaining portion 206*a* is prevented from flowing out through the air introduction path 106 to the entrance side of the air introduction path 106 (the terminal end side of the through hole 107*a* that constitutes the air introduction path 106) due to siphonage during application of centrifugal force for discharging liquid reagent X from the reagent discharge path 207*a*.

Ninth Embodiment

Figure 29:
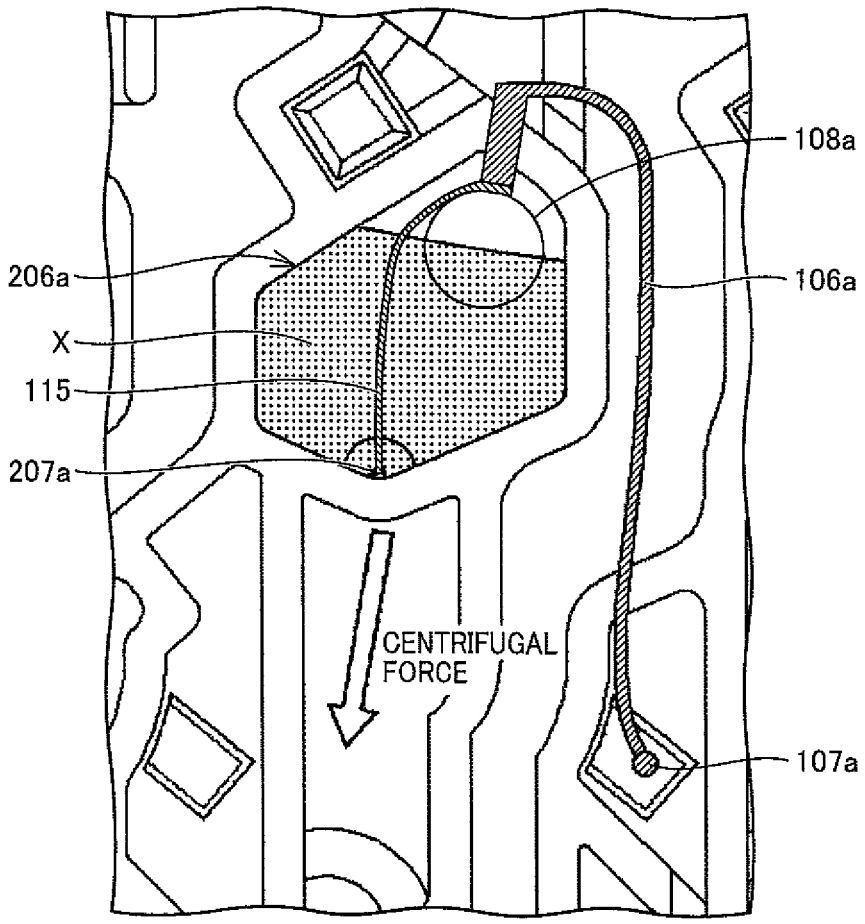
FIG. 29 is a top view showing a partially enlarged view of an example of a liquid reagent containing microchip according to a ninth embodiment.
Figure 30:
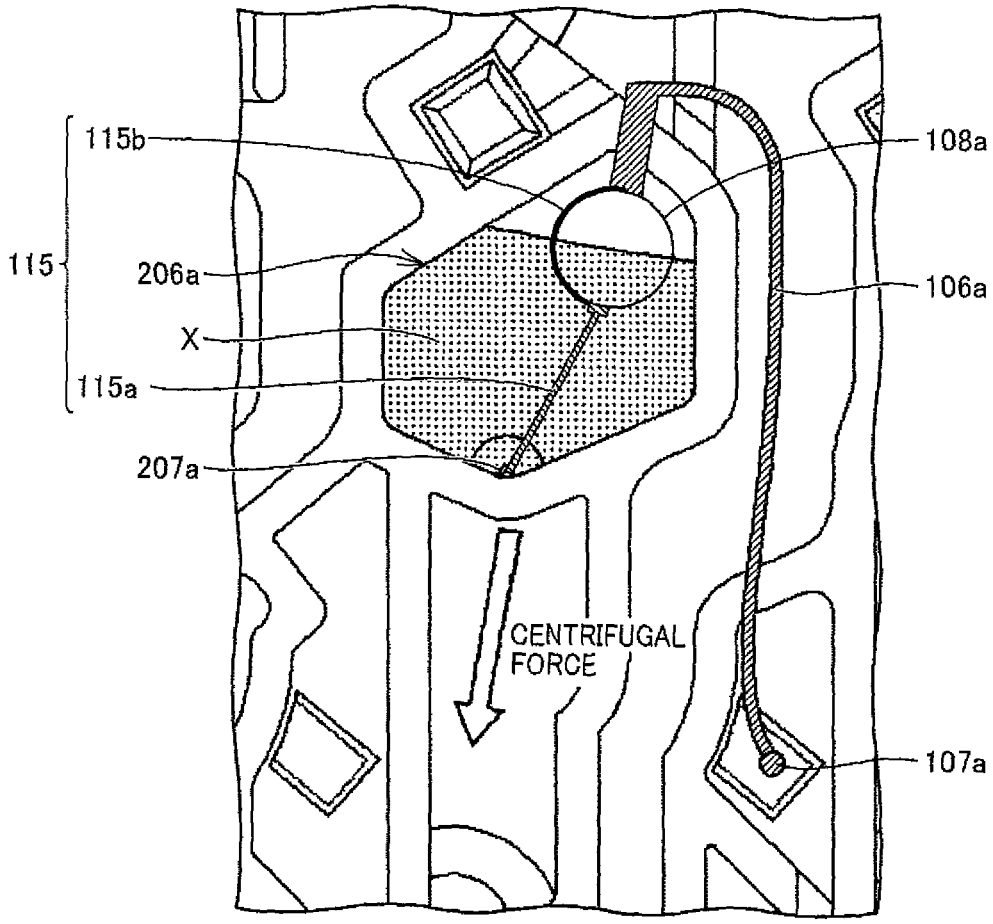
FIG. 30 is a top view showing a partially enlarged view of another example of the liquid reagent containing microchip according to the ninth embodiment.

The present embodiment also relates to the liquid reagent containing microchip (C). FIG. 29 and FIG. 30 are top views similar to FIG. 26, showing a partially enlarged view of an example of the liquid reagent containing microchip according to the present embodiment. Also in FIG. 29 and FIG. 30, the sealing layer 9 is omitted in order to facilitate clear understanding of the structure of the microchip surface and the structure of the fluid circuit.

The liquid reagent containing microchip of the present embodiment is characterized by further including, in addition to the air introduction path 106, a flow path (liquid guide path) 115 for connecting the coupling portion between the reagent retaining portion 206*a* and the reagent discharge path 207*a* with the air introduction path 106. FIG. 29 shows an example in which the flow path (liquid guide path) 115 is configured with [1] a through hole that is provided immediately above the coupling portion between the reagent retaining portion 206*a* and the reagent discharge path 207*a* (that is, immediately above the reagent discharge path 207*a*) and passes through the first substrate 4 in the thickness direction, and [2] a groove that is formed on the outer surface (the surface opposite to the second substrate 5 side) of the first substrate 4 and extends from the through hole mentioned above to the coupling portion between the reagent retaining portion 206*a* (the reagent inlet 108*a*) and the groove 106*a* that constitutes the air introduction path.

On the other hand, FIG. 30 shows an example in which the flow path (liquid guide path) 115 is configured with [1] a through hole that is provided immediately above the coupling portion between the reagent retaining portion 206*a* and the reagent discharge path 207*a* (that is, immediately above the reagent discharge path 207*a*) and passes through the first substrate 4 in the thickness direction, [2] a first liquid guide path 115*a* that is a groove formed on the outer surface (the surface opposite to the second substrate 5 side) of the first substrate 4 and extends from the through hole mentioned above to the reagent inlet 108*a*, and [3] a second liquid guide path 115*b* that is a corner portion formed with the reagent inlet 108*a* as a through hole passing through the first substrate 4 in the thickness direction and with a sealing layer 9 (not shown in FIG. 30) affixed to the surface of the first substrate 4.

The "liquid guide path" in the present embodiment is a flow path through which the liquid reagent accommodated in the reagent retaining portion may pass. In the liquid reagent containing microchip having the liquid guide path as shown in FIG. 29 and FIG. 30, after manufacture and before use of the microchip, part of liquid reagent X in the reagent retaining portion 206*a* intrudes from the terminal end on the side of the coupling portion between the reagent retaining portion 206*a* and the reagent discharge path 207*a*, moves through the liquid guide path 115, and closes the opening of the groove 106*a* of the air introduction path on the reagent retaining portion side, so that leakage of liquid reagent X from the reagent discharge path 207*a* can be prevented more effectively even when the microchip is subjected to shock after manufacture and before use of the microchip (for example, during storage or transport).

The effect of preventing leakage of liquid reagent X by means of the liquid guide path as described above is outstanding when the wettability of liquid reagent X is high.

In the example in FIG. 29, the flow path (liquid guide path) 115 may be connected only to the groove 106*a*, rather than connected to the coupling portion between the reagent retaining portion 206*a* (the reagent inlet 108*a*) and the groove 106*a* that constitutes the air introduction path.

Tenth Embodiment

Figure 31:
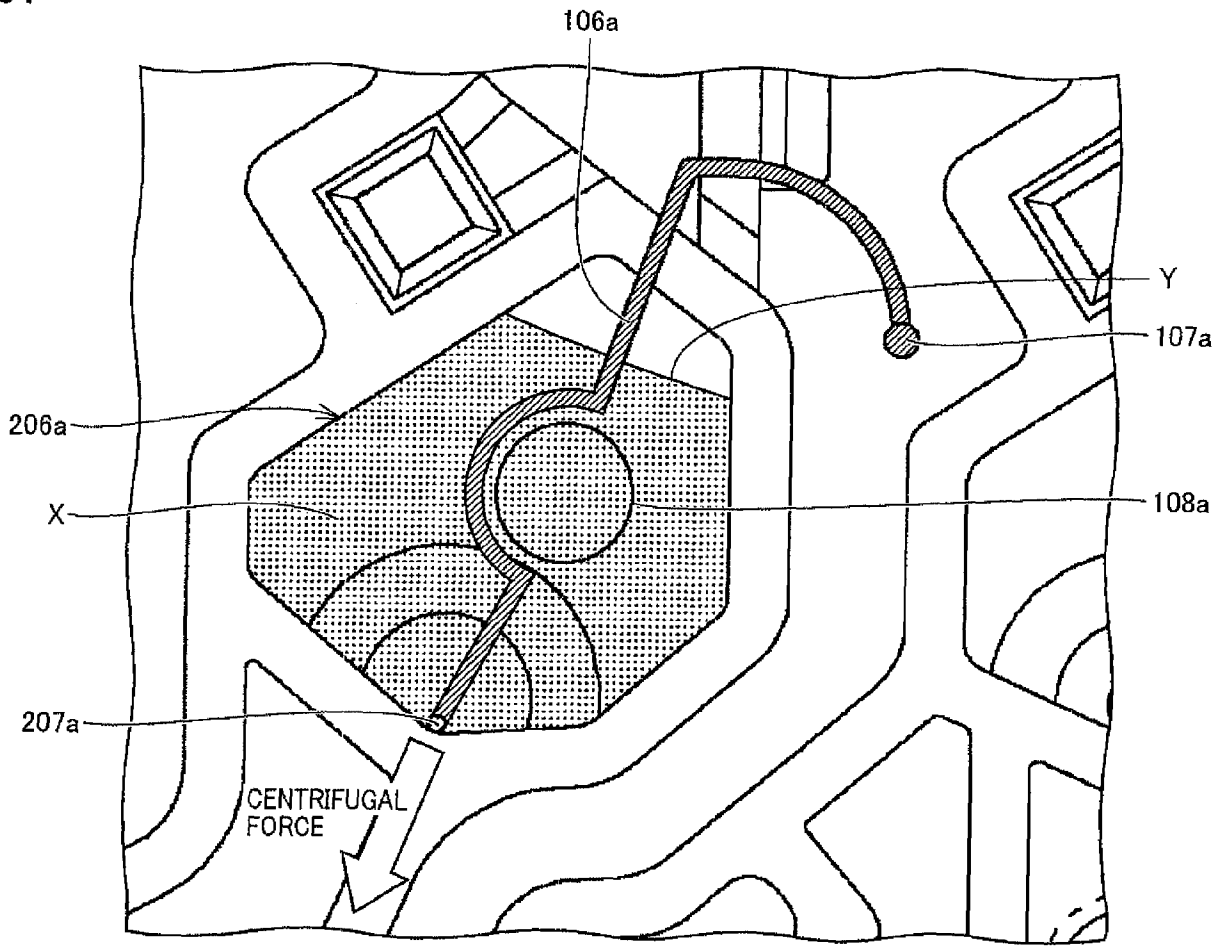
FIG. 31 is a top view showing a partially enlarged view of an example of a liquid reagent containing microchip according to a tenth embodiment.

The present embodiment also relates to the liquid reagent containing microchip (C). FIG. 31 is a top view similar to FIG. 26, showing a partially enlarged view of an example of the liquid reagent containing microchip according to the present embodiment. Also in FIG. 31, the sealing layer 9 is omitted in order to facilitate clear understanding of the structure of the microchip surface and the structure of the fluid circuit.

The present embodiment is characterized in that, unlike the air introduction path shown in FIG. 26, the coupling portion between the reagent retaining portion 206*a* and the air introduction path 106 is in proximity to or in coincident with the coupling portion between the reagent retaining portion 206*a* and the reagent discharge path 207*a*. In the example shown in FIG. 31, these coupling portions coincide. The air introduction path of the reagent retaining portion 226*a* described above belongs to the scope of the present embodiment because these coupling portions are in close proximity to each other.

In the example shown in FIG. 31, the air introduction path is configured with [1] a through hole that is provided immediately above the coupling portion between the reagent retaining portion 206*a* and the reagent discharge path 207*a* (that is, immediately above the reagent discharge path 207*a*) and passes through the first substrate 4 in the thickness direction, [2] a groove 106*a* that extends from the through hole mentioned above and is formed on the outer surface (the surface opposite to the second substrate 5 side) of the first substrate 4, and [3] a through hole 107*a* that is connected to the groove 106*a* and passes through the first substrate 4 in the thickness direction.

In the liquid reagent containing microchip of the present embodiment, as in the forgoing ninth embodiment, after manufacture and before use of the microchip, part of liquid reagent X in the reagent retaining portion 206*a* intrudes from the terminal end on the reagent retaining portion 206*a* side of the air introduction path 106 and closes the terminal end opening, so that leakage of liquid reagent X from the reagent discharge path 207*a* can be prevented more effectively even when the microchip is subjected to shock after manufacture and before use of the microchip (for example, during storage or transport).

In the present embodiment, the coupling portion between the reagent retaining portion 206*a* and the air introduction path 106 is provided on the same side as the coupling portion between the reagent retaining portion 206*a* and the reagent discharge path 207*a*, with respect to the fluid level Y formed by the entire amount of liquid reagent X in the reagent retaining portion 206*a* when centrifugal force in a prescribed direction for discharging liquid reagent X from the reagent discharge path 207*a* (centrifugal force in the approximately downward direction in FIG. 31, such as the direction of the arrow shown in FIG. 31) is applied. Therefore, in order to prevent liquid reagent X in the reagent retaining portion 206*a* from flowing out through the air introduction path 106 to the entrance side of the air introduction path 106 (the terminal end side of the through hole 107*a* that constitutes the air introduction path 106) due to siphonage during application of centrifugal force for discharging liquid reagent X from the reagent discharge path 207*a*, the through hole 107*a* that constitutes the air introduction path 106 and serves as the terminal end (entrance) of the air introduction path 106 is preferably provided on the side opposite to the coupling portion between the reagent retaining portion 206*a* and the reagent discharge path 207*a* with respect the fluid level Y described above, in a similar manner as in the foregoing eighth embodiment.

Eleventh Embodiment

Figure 32:
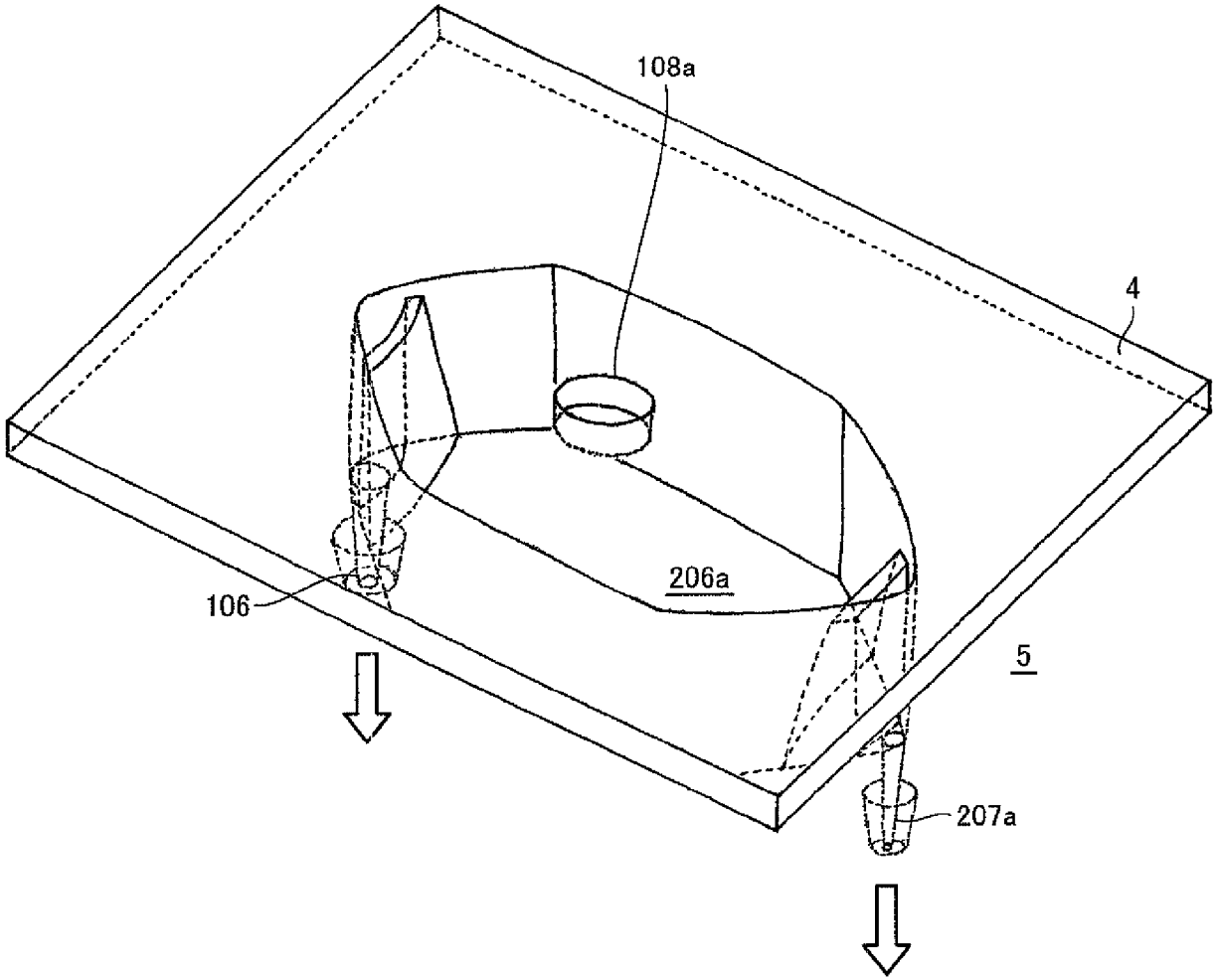
FIG. 32 is a perspective view schematically showing a partially enlarged view of a liquid reagent containing microchip according to an eleventh embodiment.

The present embodiment also relates to the liquid reagent containing microchip (C). FIG. 32 is a perspective view schematically showing a partially enlarged view of the liquid reagent containing microchip according to the present embodiment. The sealing layer 9 is also omitted in FIG. 32. In the foregoing seventh to tenth embodiments, the air introduction path is formed on the outer surface of the first substrate 4. By contrast, the present embodiment is characterized in that the air introduction path 106 is formed as a through hole extending in the thickness direction of the second substrate 5 in a similar manner as the reagent discharge path 207*a*.

As mentioned in the foregoing seventh embodiment, the through hole serving as the air introduction path 106 is preferably provided immediately above the waste storage portion for accommodating waste liquid or a flow path connected thereto, in the fluid circuit. The through hole serving as the air introduction path 106 can be brought into communication with the outside of the microchip through other flow paths and parts (chambers) that constitute the fluid circuit. On the other hand, the reagent discharge path 207*a* is generally directed to the reagent measuring portion as in the foregoing embodiments.

As shown in FIG. 32, the reagent discharge path 207*a* and the air introduction path 106 are preferably arranged to oppose each other in the reagent retaining portion 206*a*. Accordingly, the liquid reagent can be prevented from flowing out from the air introduction path 106 when centrifugal force in a prescribed direction for discharging the liquid reagent from the reagent discharge path 207*a* is applied.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A packaged liquid reagent containing microchip comprising a package and a liquid reagent containing microchip accommodated in said package, the microchip having a fluid circuit formed of a space inside thereof, in which liquid present in said fluid circuit is transferred to a desired position in said fluid circuit by applying centrifugal force, said fluid circuit including a reagent retaining portion for accommodating a liquid reagent, said microchip comprising:

a reagent inlet formed in one surface of the microchip, the reagent inlet coupled to the reagent retaining portion so that liquid reagent poured into the reagent inlet reaches the reagent retaining portion;

an air introduction path formed in said one surface of said microchip and coupled to said reagent retaining portion for introducing air into said reagent retaining portion; and a sealing portion formed on said one surface and arranged so as to cover the reagent inlet and expose at least a portion of the air introduction path when the liquid present in the fluid circuit is transferred to a desired position in the fluid circuit by applying centrifugal force, wherein:

said fluid circuit includes two or more reagent retaining portions for accommodating a liquid reagent, said air introduction path consists of two or more first paths coupled to the respective reagent retaining portions, said sealing portion is a sealing layer stacked on said outer surface of said microchip so as to cover said air introduction path, and said sealing layer has a cut to allow a portion stacked on end portions of said two or more first paths to be cut off, and said portion of said sealing layer stacked on the end portions of said two or more first paths is joined with said package.

2. A packaged liquid reagent containing microchip comprising a package and a liquid reagent containing microchip accommodated in said package, the microchip having a fluid circuit formed of a space inside thereof, in which liquid present in said fluid circuit is transferred to a desired position in said fluid circuit by applying centrifugal force, said fluid circuit including a reagent retaining portion for accommodating a liquid reagent, said microchip comprising:

a reagent inlet formed in one surface of the microchip, the reagent inlet coupled to the reagent retaining portion so that liquid reagent poured into the reagent inlet reaches the reagent retaining portion;

an air introduction path formed in said one surface of said microchip and coupled to said reagent retaining portion for introducing air into said reagent retaining portion; and a sealing portion formed on said one surface and arranged so as to cover the reagent inlet and expose at least a portion of the air introduction path when the liquid present in the fluid circuit is transferred to a desired position in the fluid circuit by, applying centrifugal force wherein:

said fluid circuit includes two or more reagent retaining portions, and said air introduction path consists of two or more first paths coupled to the respective reagent retaining portions and one second path extending so as to be connected to all of said two or more first paths, said sealing portion is a sealing layer stacked on said outer surface of said microchip so as to cover said air introduction path, and said sealing layer has a cut to allow a portion stacked on an end portion of said second path to be cut off, and said portion of said sealing layer stacked on the end portion of said second path is joined with said package.

3. A packaged liquid reagent containing microchip comprising a package and a liquid reagent containing microchip accommodated in said package, the microchip having a fluid circuit formed of a space inside thereof, in which liquid present in said fluid circuit is transferred to a desired position in said fluid circuit by applying centrifugal force, said fluid circuit including a reagent retaining portion for accommodating a liquid reagent, said microchip comprising:

a reagent inlet formed in one surface of the microchip, the reagent inlet coupled to the reagent retaining portion so that liquid reagent poured into the reagent inlet reaches the reagent retaining portion;

an air introduction path formed in said one surface of said microchip and coupled to said reagent retaining portion for introducing air into said reagent retaining portion; and a sealing portion formed on said one surface and arranged so as to cover the reagent inlet and expose at least a portion of the air introduction path when the liquid present in the fluid circuit is transferred to a desired position in the fluid circuit by applying centrifugal force, wherein said sealing portion is a sealing layer stacked on said outer surface of said microchip so as to cover said air introduction path and wherein part of said sealing layer is composed of part of said package.

* * * * *